US005565002A

United States Patent [19]

Rawls et al.

[11] Patent Number: 5,565,002

[45] **Date of Patent: *Oct. 15, 1996**

22

[54] EXERCISE APPARATUS

[75] Inventors: R. Lee Rawls, Woodinville; James A. Duncan, Renton, both of Wash.

[73] Assignee: StairMaster Sports/Medical Products, L.P., Kirkland, Wash.

[ * ] Notice: The term of this patent shall not extend beyond the expiration date of Pat. No. 5,354,248.

[21] Appl. No.: 215,121

[22] Filed: Mar. 18, 1994

Related U.S. Application Data

[63] Continuation-in-part of Ser. No. 33,870, Mar. 19, 1993, Pat. No. 5,354,248.

[51] Int. Cl.[6] ..... A63B 21/22

[52] U.S. Cl. ..... 482/6; 482/72; 482/99

[58] Field of Search ..... 462/1–6, 72, 93–103, 462/136, 137, 903

[56] References Cited

U.S. PATENT DOCUMENTS

| | | |
|---|---|---|
| 580,420 | 4/1897 | Nickerson . |
| 1,707,791 | 4/1925 | Anderson . |
| 3,445,108 | 5/1969 | Fenner et al. . |
| 3,599,974 | 8/1971 | Price . |
| 3,782,718 | 1/1974 | Saylor . |
| 3,792,860 | 2/1974 | Selnes . |
| 3,794,316 | 2/1974 | Toman . |
| 3,822,599 | 7/1974 | Brentham . |
| 3,848,870 | 11/1974 | Craig . |
| 4,082,267 | 4/1978 | Flavell . |
| 4,140,312 | 2/1979 | Buchmann . |
| 4,169,591 | 10/1979 | Douglas . |
| 4,199,139 | 4/1980 | Mahnke et al. . |
| 4,240,627 | 12/1980 | Brentham . |
| 4,247,098 | 1/1981 | Brentham . |
| 4,357,010 | 11/1982 | Telle . |
| 4,397,462 | 8/1983 | Wilmarth . |
| 4,402,505 | 9/1983 | Young . |
| 4,426,077 | 1/1984 | Becker . |
| 4,429,871 | 2/1984 | Flechner . |
| 4,469,325 | 9/1984 | Ware . |
| 4,512,570 | 4/1985 | Tardivel . |

(List continued on next page.)

FOREIGN PATENT DOCUMENTS

| | | |
|---|---|---|
| 218733 | 2/1985 | German Dem. Rep. . |
| 150850 | 4/1904 | Germany . |
| 605957 | 11/1934 | Germany . |
| 1097873 | 1/1961 | Germany . |
| 5223423 | 2/1977 | Japan . |
| 825121 | 4/1981 | U.S.S.R. . |
| 886916 | 12/1981 | U.S.S.R. . |
| 935117 | 6/1982 | U.S.S.R. . |
| 1044299 | 9/1983 | U.S.S.R. . |
| 1204219 | 1/1986 | U.S.S.R. . |
| 1750713 | 7/1992 | U.S.S.R. ..... 482/2 |

*Primary Examiner*—Richard J. Apley
*Assistant Examiner*—John Mulcahy
*Attorney, Agent, or Firm*—Seed and Berry LLP

[57] ABSTRACT

An exercise apparatus having a vertically movable weight, and a kayak paddle-like handle engaged by the user to input an input power with a unidirectional exercise force at a user-selected velocity for moving the weight upward. Also included is a brake applying a negative braking power with a unidirectional braking force opposing the exercise force. The braking power has a braking velocity for permitting downward movement of the weight. A brake controller controls the application of the brake to maintain the braking velocity at a selected velocity for at least a selected portion of the user's exercise time. A differential member is coupled to the weight and receives the input power and the braking power. The differential member determines a differential between the user-selected velocity and the selected braking velocity, and applies the resultant to movement of the weight. If the user-selected velocity is greater than the braking velocity, the weight is lifted, and if the user-selected velocity is less than the selected braking velocity, the weight is lowered. If they match, the weight is maintained in a stationary elevated position.

127 Claims, 7 Drawing Sheets

U.S. PATENT DOCUMENTS 4,687,197 8/1987 Larsson et al. .
4,708,338 11/1987 Potts .
4,709,919 12/1987 Cano .
4,717,145 1/1988 Chininis .
4,775,146 10/1988 Stankovic .
4,822,032 4/1989 Whitmore et al. .
4,822,036 4/1989 Dang .
4,842,268 6/1989 Jenkins .
4,869,497 9/1989 Stewart et al. ..... 482/5
4,921,244 5/1990 Berroth .
4,938,474 7/1990 Sweeney et al. .
4,940,227 7/1990 Coffey .
4,941,652 7/1990 Nagano et al. .
5,015,926 5/1991 Casler .
5,060,938 10/1991 Hawley, Jr. .
5,135,447 8/1992 Robards, Jr. et al. .
5,180,351 1/1993 Ehrenfried .
5,354,248 10/1994 Rawls et al. ..... 482/6

10
148
63
136
146
58
138
52
138
54
140
144
62
90
56
60
84
85
70
81
94
95
56
96
97
84
86
17
30
104
84
144
116
112
118
76
72
78
14
12
74
54
48
44
46
43
21
102
36
114
116
110
124
126
108
106
150
24
148
18
21
18
20
19
19
19

EXERCISE APPARATUS

CROSS-REFERENCE TO RELATED APPLICATION

This application is a continuation-in-part of U.S. application Ser. No. 08/033,870, filed Mar. 19, 1993, now U.S. Pat. No. 5,354,248.

TECHNICAL FIELD

The present invention relates generally to exercise apparatus, and more particularly, to a machine which facilitates exercise using a controlled exercise force and speed and simulates the exercise provided by paddling a kayak.

BACKGROUND OF THE INVENTION

Exercise machines of various designs exist to improve muscle strength and coordination and provide aerobic exercise. It has long been desired to provide an exercise machine that is able to fully and independently control both velocity and load. A machine capable of producing controlled load exercise provides a constant resistance force against which the user exercises through a desired range of motion, independent of the velocity of the movement. A controlled velocity exercise machine provides a constant speed through the desired range of motion, independent of the force applied. It is desirable to have an exercise machine that allows both controlled load and controlled velocity exercise.

It is also desirable to provide such an exercise machine which simulates the beneficial exercise provided by paddling a kayak.

The present invention fulfills these needs, and provides other related advantages.

SUMMARY OF THE INVENTION

The present invention resides in an exercise apparatus for a human user. The apparatus includes a vertically movable weight or an alternative form of a resistance member which applies a resistance force. The apparatus also includes an input mechanism engaged by the user to input a positive input power with a unidirectional exercise force at a user-selected velocity for moving the weight upward. The input mechanism includes in the illustrated embodiment of the invention a handle engageable by at least one hand of the user and moveable to input the input power. A speed control such as a brake is provided to apply a negative braking power with a unidirectional braking force opposing the exercise force, the braking power having a braking velocity for permitting downward movement of the weight. A brake controller controls the application of the brake to maintain the braking velocity at a selected velocity for at least a selected portion of the user's exercise time. The selected braking velocity may be a constant velocity.

A differential member is coupled to the weight and receives the input power from the input mechanism and the braking power from the brake. The differential member determines a differential between the user-selected velocity and the selected braking velocity, and applies the resultant to the weight so that if the user-selected velocity is greater than the selected braking velocity the weight is lifted, and if the user-selected velocity is less than the selected braking velocity the weight is lowered. As such, the user during at least the selected portion of the user's exercise time can apply input power to lift the weight to a desired elevation and maintain the weight at about the desired elevation by applying input power with the user-selected velocity substantially matching the selected constant braking velocity.

In the illustrated embodiment of the invention, the handle of the apparatus is rotatable by the user to input the input power. The handle is also laterally tiltable by the user while being rotated to input the input power. The handle is rotatable by the user in both clockwise and counterclockwise directions to input clockwise and counterclockwise rotational input power. The input mechanism further includes a unidirectional drive assembly to sum the clockwise and counterclockwise rotational input power into unidirectional rotational input power, the unidirectional drive assembly being coupled to the differential member to transmit the unidirectional rotational input power thereto.

In the illustrated embodiment of the invention, the apparatus includes a flexible member interconnecting the input mechanism, the brake and the differential member to transmit the input power and the braking power to the differential member. The differential member includes a movable trolley with the weight coupled thereto so that movement of the trolley in a first direction lifts the weight and movement of the trolley in a second direction lowers the weight. The trolley is engaged by the flexible member to produce movement of the trolley in the first direction if the user-selected velocity is greater than the selected braking velocity, and to produce movement of the trolley in the second direction if the user-selected velocity is less than the selected constant braking velocity.

The flexible member is in the form of an endless loop operatively engaged by the brake to transmit the braking power thereto and by the input mechanism to transmit the input power thereto. The flexible member includes a first length extending between the brake and the input mechanism with the trolley engaging the first length. The trolley includes a first idler which rides on the flexible member and around which the first length is engaged. The trolley also includes a second idler around which a return second length of the flexible member extends. The second length extends between the brake and the input mechanism. As such, slack in the endless loop is avoided as the trolley moves between the first and second directions.

In the illustrated embodiment, the apparatus further includes an adjustment member selectively adjustable by the user to select the selected constant braking velocity of the braking power applied by the brake. The selected braking velocity is selectively adjustable by the user independent of the mass of the weight.

The weight comprises a stack of individual weights and means for the user to lock selected ones of the individual weights together to form the weight. The adjustment member allows the user to select the selected velocity component of the braking power applied by the brake, independent of the number of the individual weights the user selects to lock together.

The selected velocity component of the braking power applied by the brake is selectively adjustable during the user's exercise time according to a predetermined pattern. In such manner, the user may vary the selected braking velocity during the selected portion of the user's exercise time from the selected constant braking velocity during at least one or more other selected portions of the user's exercise time.

In the illustrated embodiment, the flexible member is in the form of an endless loop of chain operatively engaged by the input mechanism and the brake, and operatively engaging the differential member to transmit the input power and the braking power to the differential member. The brake includes an alternator operating in conjunction with a load resister. The rotational speed of the alternator determines the braking velocity of the braking power applied by the brake. The brake controller includes a feedback loop controlling the load applied to the alternator, to control the rotational speed of the alternator.

The brake includes a rotatable brake member around which the flexible member is engaged so that the flexible member is fed to the differential member at a feed rate by the rotation of the rotatable brake member during at least the selective portion of the user's exercise time. The input mechanism includes a rotatable input member around which the flexible member is engaged so that the flexible member is drawn away from the differential member at a draw rate determined by the rotational speed of the rotatable input member.

Other features and advantages of the invention will become apparent from the following detailed description, taken in conjunction with the accompanying drawings.

DETAILED DESCRIPTION OF THE INVENTION

Figure 1:
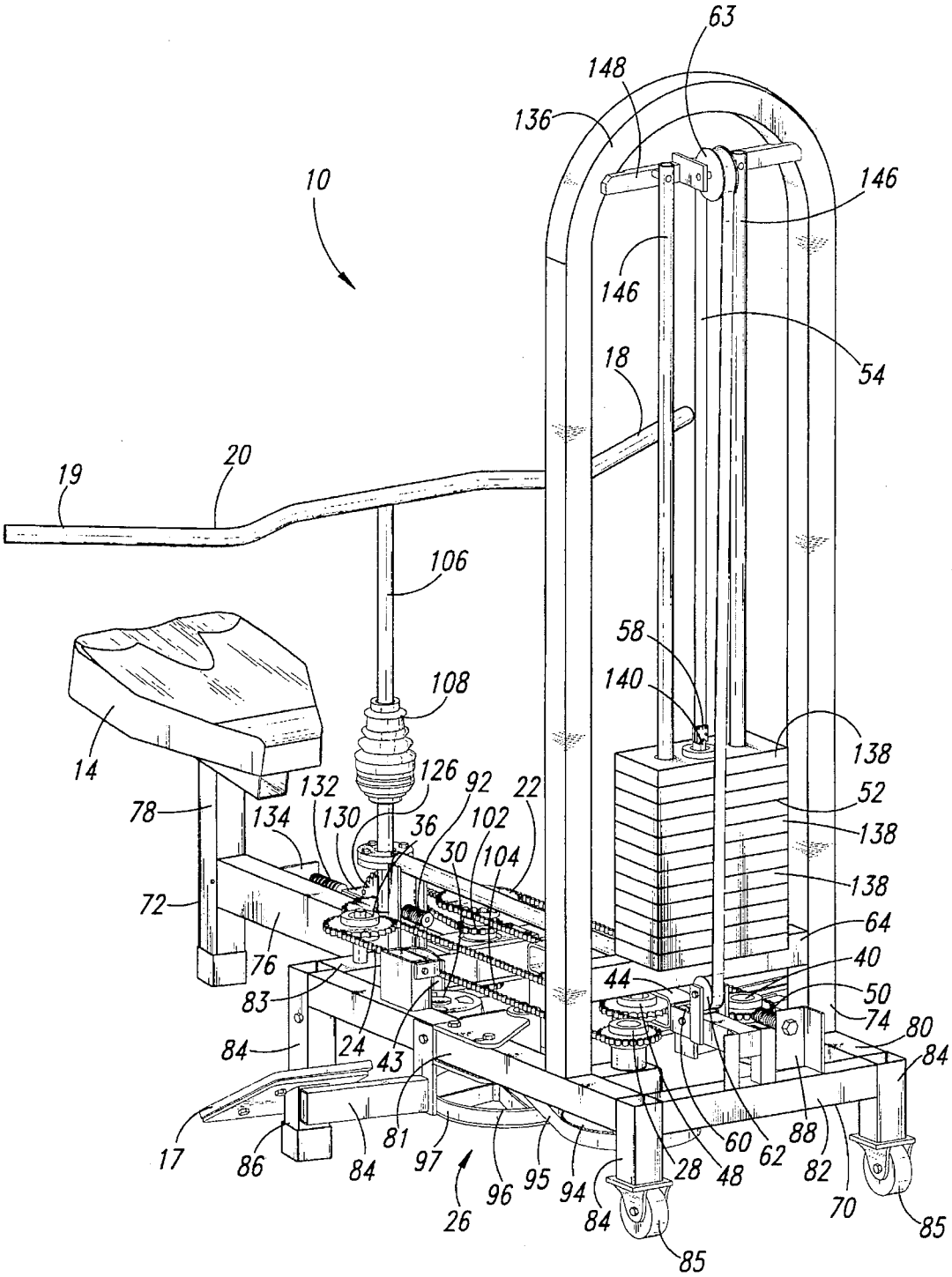
FIG. 1 is a right side isometric view of an exercise apparatus embodying the present invention.

As shown in the drawings for purposes of illustration, the present invention is embodied in an exercise apparatus, indicated generally by the reference numeral 10. The apparatus 10 is shown schematically in the functional block diagram of FIG. 7 as including a resistance force 1, an input mechanism 2, a speed control 3 (which in the illustrated embodiment includes a brake 4 and a brake controller 5), and a differential 6. For purposes of understanding the functional operation of the apparatus 10, the input 2 may be considered as being engaged by a user to input a positive input power having a unidirectional exercise force component determined by the magnitude of the resistance force 1 and a user-selected velocity component indicated by arrow 7. The brake 4 applies a negative braking power with a unidirectional force component determined by the magnitude of the resistance force 1 and with a braking velocity component indicated by arrow 8 set by the brake controller 5. The braking force component opposes the exercise force component, and the combined exercise force and braking force are in balance with the resistance force.

The brake controller 5 controls the application of the brake 4 to maintain the braking velocity at a selected velocity, preferably a constant velocity, for at least a selected portion of the user's exercise time. The differential 6 is coupled to the resistance force 1 and receives the input power from the input 2 and the braking power from the brake 4.

As will be described in more detail below, if the resistance force 1 takes the form of a weight, the positive input power applied to the input 2 by the user is for moving the weight upward. Similarly, when the speed control 3 is a brake 4, the application of the negative braking power by the brake permits the downward movement of the weight.

The differential 6 determines a differential between the user-selected velocity component 7 of the input power and the selected constant braking velocity component 8 of the braking power, and applies the resultant to the movement of resistance force 1 (e.g., the weight if used) so that if the user-selected velocity component is greater than the selected constant braking velocity the weight is lifted, and if the user-selected velocity component is less than the selected constant braking velocity the weight is lowered. As such, the user during at least a selected portion of the user's exercise time can apply input power to lift the weight to a desired elevation and maintain the weight at about the desired elevation by applying input power with the user-selected velocity substantially matching the selected constant braking velocity. Since the combined exercise force and braking force are balanced against the resistance force 1, the exercise is achieved with a controlled, constant load which does not vary during the exercise unless the resistance force 1 is changed by the user. Also, the exercise is achieved with a controlled, constant velocity which does not vary significantly during the exercise unless the selected constant braking velocity is changed by the user since the input velocity is selected by the user in order to match the selected constant braking velocity. Thus, the user during use of the apparatus 10 exercises, for at least a portion of the user's exercise time, using a substantially constant exercise force at a substantially constant speed. The result being a controlled velocity and controlled load exercise.

Figure 8:
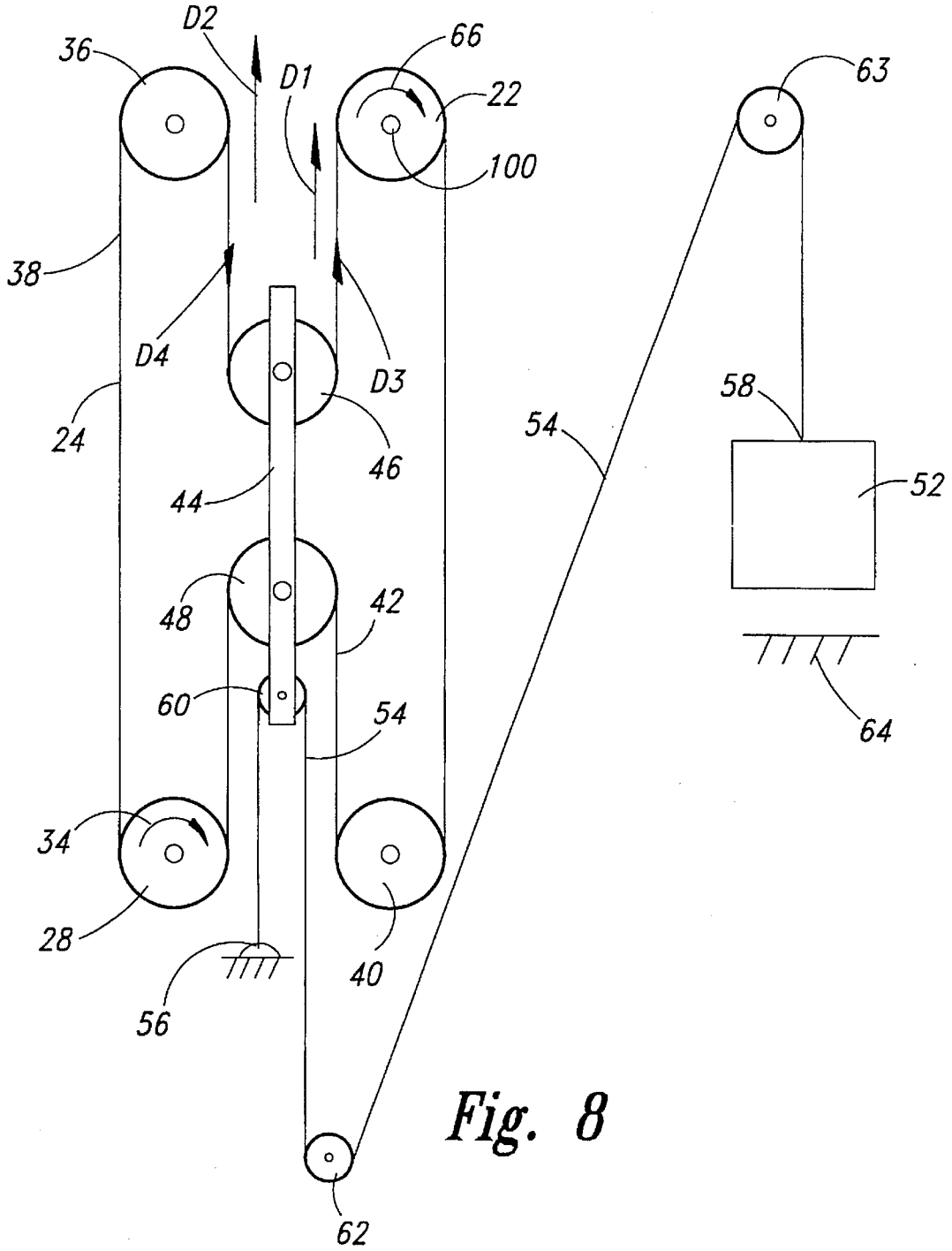
FIG. 8 is a schematic drawing illustrating the operation of the exercise apparatus of FIG. 1.

The presently preferred embodiment of the invention is illustrated in FIGS. 1–6, and schematically in FIG. 8. The exercise apparatus 10 is configured for a human user 12 (see FIGS. 2 and 3) to exercise by sitting upon a stationary, cushioned seat 14. Left and right stationary foot pads 16 and 17, respectively, are provided for placement of the user's feet thereon to help stabilize the user on the seat 14 and assist the user in alternately applying rearward and forward force (i.e., clockwise and counterclockwise force) on left and right handgrips 18 and 19, respectively, of a kayak paddle-like handle 20 using the user's hands to selectively rotate and tilt the handle. The rearward and forward force applied by the user 12 provides the positive input power to the exercise apparatus 10.

As will be described in more detail below, the positive input power applied by the user 12 through the left and right handgrips 18 and 19 is transmitted through a unidirectional clutch assembly 21 (see FIGS. 4 and 6) to an input drive gear 22. The input power is converted to a unidirectional exercise force component applied in the direction indicated by arrow D1 (see FIGS. 5 and 8) with a user-selected velocity component. While the user selects the input velocity, the apparatus 10 provides a means whereby the user is able to maintain a selected, substantially constant velocity.

Figure 5:
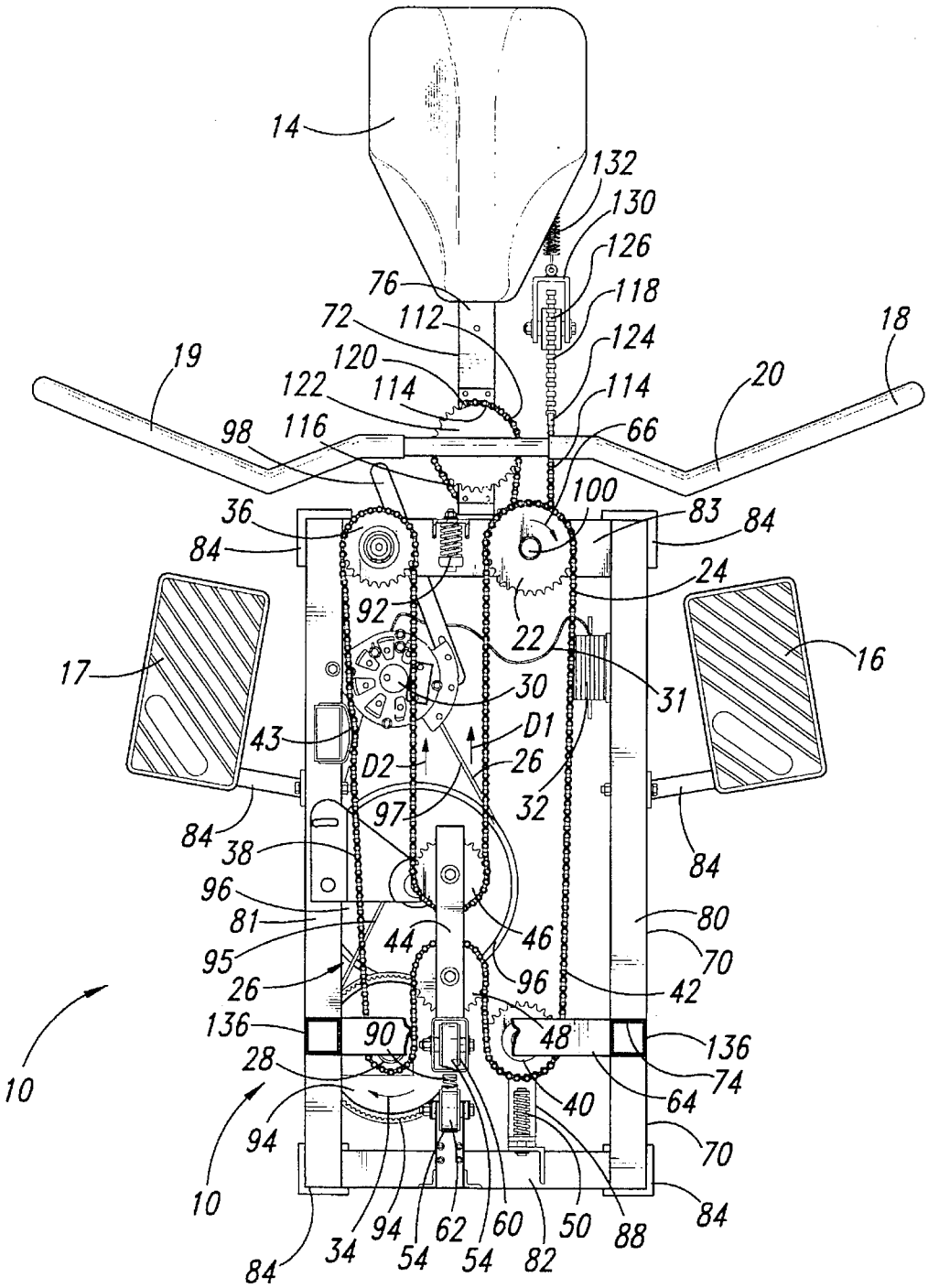
FIG. 5 is a fragmentary, top plan view of the exercise apparatus of FIG. 1.

As best illustrated in FIG. 5, an endless loop of chain 24 is entrained on the input drive gear 22 and has the input power applied thereto. The chain 24 is also entrained on a braking gear 28. As will be described in greater detail below, the braking gear 28 is connected to an alternator 30 through a series of pulleys and belts, indicated generally by reference numeral 26. The alternator 30 has a load resistor 32 in its circuit with the electrical output of the alternator 30 being electrically connected by a cable 31 to the load resistor to apply a negative braking power. The braking power has a unidirectional braking force applied to the chain 24 in the direction indicated by arrow D2. It is noted that when following the path of the chain 24, the braking force opposes the exercise force, although with a spatial frame of reference both are in the same rearward direction along the portions of the chain immediately adjacent the arrows D1 and D2 in FIG. 5.

A feedback loop switches on and off the current from the alternator 30 to the load resistor 32 by switching on and off the current to the field winding of the alternator 30 in such a manner that work done by the alternator is managed in a controlled fashion and work is required to turn the alternator. Thus, a load is selectively put on the alternator 30 and the braking gear 28 so as to maintain the rotational speed of the alternator and the braking velocity of the braking gear, and hence the velocity of the portion of the chain 24 passing by the braking gear, at a selected constant velocity for at least a desired selected portion of the user's exercise time. The load on the alternator 30 is removed and no braking force is applied if the velocity of the braking gear 28 is below the selected constant velocity, and the load on the alternator is applied and the braking force thereby applied if the velocity of the braking gear is above the selected constant velocity. This results in substantially constant velocity of the braking gear 28. The velocity of the braking gear 28 is controlled by switching the current to the alternator field winding and thereby to the load resistor 32, and hence the braking power it supplies, many times per second to provide smooth operation. As will be described below, this constant velocity may be changed by the user for other portions of the exercise time.

The chain 24 is also entrained on a fixed idler gear 36 located along a first run or length 38 of the chain extending from the braking gear 28 to the input drive gear 22, and on a tensioning idler gear 40 located along a second run or length 42 of the chain extending from the input drive gear 22 to the braking gear 28. The first and second lengths 38 and 42 form the endless loop of the chain 24. Vibration of the chain 24 is reduced by an anti-vibration guide 43.

A trolley 44 has a rearwardly positioned first trolley idler gear 46 around which the first length 38 of the chain 24 extends to form a forwardly looping portion of the first length 38 of the chain 24 located between the fixed idler gear 36 and the input drive gear 22. The trolley 44 has a forwardly positioned second trolley idler gear 48 around which the return second length 42 of the chain 24 extends to form a rearwardly looping portion of the second length 42 of the chain 24 located between the tensioning idler gear 40 and the braking gear 28. The trolley 44 is suspended between the forwardly and rearwardly looping portions of the chain 24 for rearward and forward movement as the first and second lengths 38 and 42 of the chain 24 shorten and lengthen during use of the apparatus 10, as will be described in greater detail below. With this arrangement, slack in the chain 24 is avoided as the trolley 44 moves rearward and forward. A spring 50 applies a forward bias to the tensioning idler gear 40 to help maintain a desired tension on the endless loop of the chain 24.

The trolley 44 is operatively connected to a stack of weight 52 (see FIGS. 1–3) by a flexible strap 54. The strap 54 has one end 56 (see FIGS. 2 and 3) held stationary and another end 58 attached to the weight 52. The strap 54 passes over an idler pulley 60 carried by the trolley 44 as it moves rearward and forward. An arrangement of two pulleys 62 and 63 are used to connect the strap 54 to the weight 52 to transmit the rearward movement of the trolley 44 to the weight 52 and cause lifting of the weight above a rest 64 when the trolley moves rearward, and to transmit the forward movement of the trolley to the weight and permit lowering of the weight toward the rest 64 when the trolley moves forward.

The trolley 44 serves as a differential member that effectively has its output coupled to the weight 52, and two inputs coupled to the chain 24 to receive the input power from the input drive gear 22 and the braking power from the braking gear 28 (as discussed above with reference to FIG. 7). The user 12 through the repeated, alternating rearward and forward movement of the left and right handgrip portions 18 and 19 of the kayak paddle-like handle 20 uses his hands and his upper body and other muscles to input the positive input power with a unidirectional exercise force component. The input velocity component of the input power is translated into rotational drive of the input drive gear 22 in the direction indicated by arrow 66 resulting in a user-selected input velocity component on the chain 24 in the rearward direction of arrow D3, as seen in FIGS. 5 and 8. This causes the chain 24 to move past the input drive gear 22 with the user-selected input velocity and the endless loop to circulate in the clockwise direction, as viewed from above in FIGS. 5 and 8. As will be described below, the force applied by the user to the left and right handgrips 18 and 19 to produce rotation of the kayak paddle-like handle 20 both input the user's input power to the apparatus 10.

The operation of the alternator 30 and the load resister 32 are controlled to generate the negative braking power with a unidirectional drag or braking force component on the chain 24 in the direction of arrow D2 which opposes the exercise force component and with a selected constant braking velocity component in the direction D4 (see FIG. 8). The selected constant braking velocity component of the braking power is translated into rotation of the braking gear 28 at a selected, substantially constant speed in the direction indicated by arrow 34. This causes the chain 24 to move past the braking gear 28 with the selected constant braking velocity and the endless loop to circulate in the clockwise direction, as viewed in FIGS. 5 and 8. In effect, the chain 24 is fed to the trolley 44 at a selected, substantially constant feed rate determined by the rotational speed of the braking gear 28, and the chain is drawn away from the trolley at a draw rate determined by the rotational speed of the input drive gear 22. The result is that trolley 44 acts to determine the differential between the user-selected velocity component and the selected constant braking velocity component, and the resultant is applied to the weight 52 through the strap 54 to lift or lower the weight. Resulting rearward movement of the trolley 44 lifts the weight 52, and resulting forward movement of the trolley allows the weight to move downward.

Figure 3:
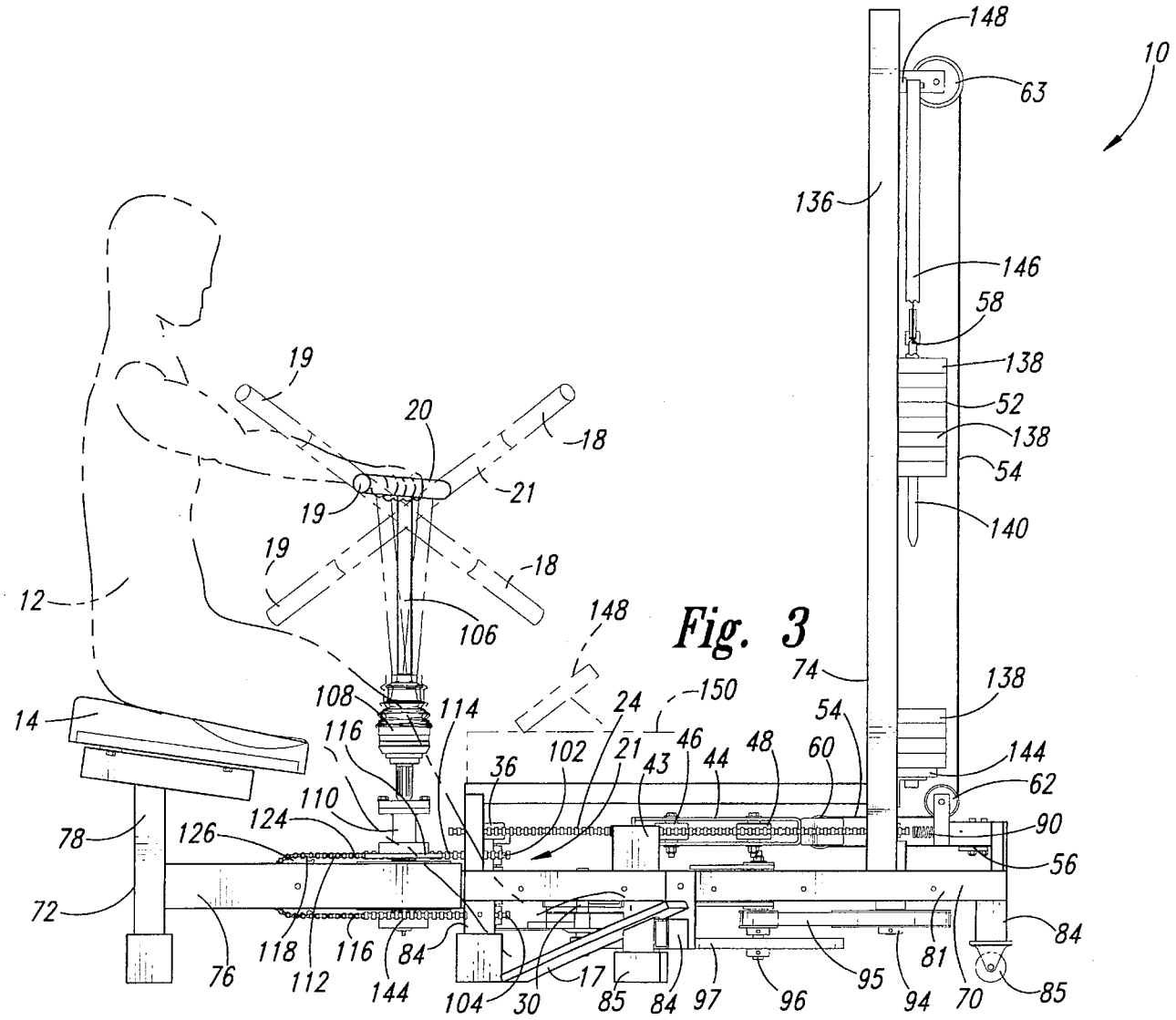
FIG. 3 is a right side, fragmentary, elevational view of the exercise apparatus of FIG. 1 showing a user in phantom line exercising to cause a selected portion of the weight stack to be lifted and maintained above the rest position.

Whether the input drive gear 22 is drawing the chain 24 away from the trolley 44 faster or slower than the speed at which the braking gear 28 is feeding the chain toward the trolley, determines whether the weight 52 is lifted, or the weight is lowered. If the user-selected velocity is greater than the selected constant braking velocity, the trolley 44 moves rearward and the weight 52 is lifted, but if the user-selected velocity is less than the selected constant braking velocity, the trolley moves forward and the weight is lowered. If the user-selected velocity exactly matches the selected constant braking velocity, the trolley 44 does not move and the weight 52 will stay in a suspended position lifted off of the rest 64 such as is shown in FIG. 3 for as long as this matched velocity condition is maintained by the user 12.

The preferred operation of the apparatus 10 to achieve the desired substantially controlled load and controlled velocity exercise is for the user 12 to apply sufficient input power through the operation of the left and right handgrip portions 18 and 19 so that the weight 52 will be initially raised to a desired elevated position and then to maintain the weight at about that desired elevated position by applying input power with the user-selected velocity substantially matching the selected constant braking velocity. This is accomplished by applying the input power with a velocity selected by the user which causes rotation of the input drive gear 22 to draw the chain 24 away from the trolley 44 at a speed substantially matching the rate the braking gear 28 is feeding the chain toward the trolley. In such manner, the input power is applied with an input velocity substantially matching the selected constant braking velocity.

It is noted that while the user 12 may apply a greater or lesser input power to the apparatus 10, the exercise force component can never be increased or decreased during an exercise from the magnitude that is determined by the mass of the weight 52 selected by the user for the exercise (i.e., the weight setting), and that mass is held constant during each selected portion of the user's exercise time. Only by selecting a different mass for the weight 52 can the exercise force component of the input power be changed. If a greater or lesser input power is applied by the user without changing the mass of the weight 52, only the input velocity component will change, not the exercise force component.

It is also noted that if the user 12 applies an input power to the apparatus 10 with a magnitude appropriate to maintain the weight 52 at the desired elevated position, the input velocity component of the input power will be determined by the constant braking velocity selected by the user for the exercise (i.e., the brake setting), and that braking velocity is held constant during at least a selected portion of the user's exercise time.

Should the user 12 begin to apply a greater input power to the input drive gear 22, as a result of increasing the input velocity component of the input power, the weight 52 will move upward because a differential results, with the speed of the input drive gear 22 and the chain portion it drives being greater than the speed of the braking gear 28 and the chain portion it drives. This is an indicator for the user 12 to reduce the input power to maintain the weight 52 at its new elevation or return the weight to the original elevated position.

On the other hand, should the user decrease the input power being applied to the input drive gear 22, as a result of decreasing the input velocity component of the input power, the weight 52 will move downward because a differential results, with the speed of the input drive gear 22 and the chain portion it drives being less than the speed of the braking gear 28 and the chain portion it drives. This is an indication for the user 12 to increase the input power to maintain the weight 52 at its new elevation or return the weight to the original elevated position.

To maintain the weight at any selected elevational position, the user must attempt to apply an input power through variation of the input velocity component which will substantially match the selected constant braking velocity, thus producing the desired substantially controlled velocity and controlled load exercise. This occurs when the input drive gear 22 draws the chain 24 away from the trolley 44 at the same rate that the braking gear 28 feeds the chain to the trolley.

It is noted that the mass of the weight 52 is directly linked to the movement of the trolley 44 and when the input velocity component of the input power matches the selected constant braking velocity component of the braking power, the weight 52 does not move up or down. This is so even though exercise is being conducted at a relatively high input velocity and exercise force. Thus, the problems encountered in the past with exercise machines utilizing a moving weight which produced rapid acceleration and deceleration of the weight during an exercise cycle are substantially eliminated. With the apparatus 10 of the present invention, little movement of the weight 52 is encountered regardless of the input velocity or force selected for the exercise.

The apparatus 10 is constructed using a base frame structure 70 attached to a rear frame structure 72 and supporting a front frame structure 74. The rear frame structure 72 has a horizontal frame member 76 which has a forward end portion rigidly attached to the base frame structure 70 and a rearward end portion rigidly attached to a vertical seat support member 78. The seat support member 78 supports the cushioned seat 14 on which the user sits during exercise using the apparatus 10.

The base frame structure 70 includes left and right horizontal side frame members 80 and 81, respectively, which extends between front and rear horizontal frame members 82 and 83, respectively, to define a rectangular support frame supported above the floor at each corner by a leg 84. The two forward legs 84 each have a floor engaging wheel 85 to facilitate changing the location of the apparatus 10 by picking up the rearward end of the apparatus and moving it about much like a wheelbarrow with the weight of the front frame structure 74 and the weight 52 being generally over the wheels 85. The left and right foot pads 16 and 17 are each rigidly attached to a corresponding one of the left and right horizontal side frame members 80 and 81 by a connection arm 84 and supported above the floor by a leg 86.

The base frame structure 70 serves to support much of the moving components of the apparatus 10. In particular, the idler gear 36 and the input drive gear 22 are rotatably mounted to and above the rear horizontal frame member 83. The braking gear 28 is positioned forward of the idler gear 36 and rotatably mounted to the right horizontal side frame member 81. The tensioning idler gear 40 is positioned forward of the input drive gear 22 and rotatably mounted to the front horizontal frame member 82 by a connector mechanism 88 incorporating the tensioning spring 50. The trolley 44 is suspended between these gears on the endless loop of chain 24 for rearward and forward movement. The front horizontal frame member 82 has a stop spring 90 and the rear horizontal frame member 83 has a stop spring 92 in position to be engaged by the front and rear ends, respectively, of the trolley 44 should the trolley move to the fullest extent possible forward or rearward to provide a cushioned stop.

Figure 2:
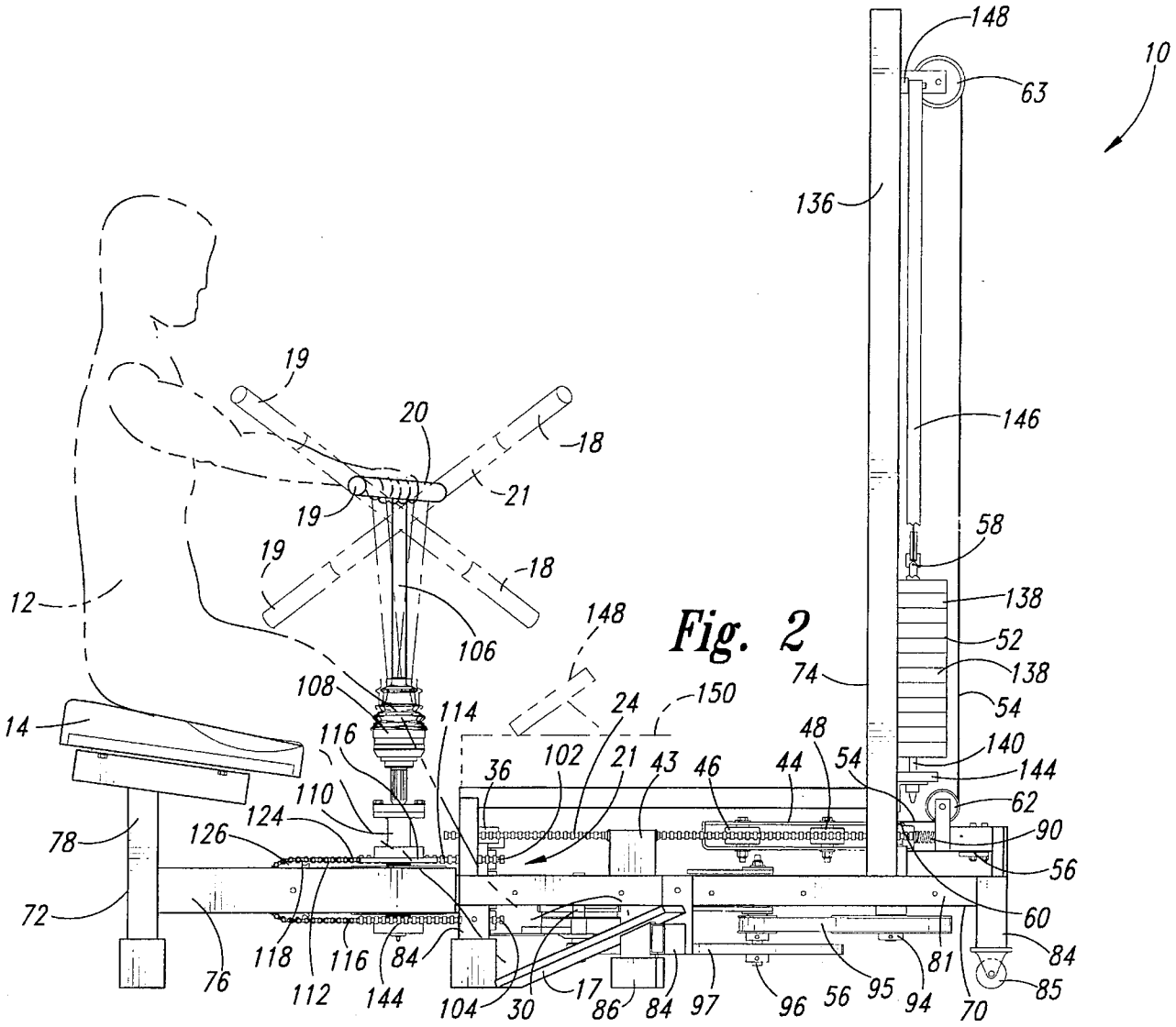
FIG. 2 is a right side, fragmentary, elevational view of the exercise apparatus of FIG. 1 showing a user in phantom line exercising to cause a full stack of weights to be slightly lifted from a rest position.

The alternator 30 is pivotally mounted to the right horizontal side frame member 81, and, as discussed above, a series of pulleys and belts 26 connects the shaft of the alternator to the braking gear 28. This series of pulleys and belts 26 are located below the run of the chain 24 and the base frame structure 70, and includes a large diameter pulley 94 attached on a common shaft with the braking gear 28, and a pair of intermediate pulleys 96 mounted to the right horizontal side frame member 81. As best shown in FIGS. 2 and 3, a belt 95 is entrained on the pulley 94 and a small diameter pulley comprising one of the pair of intermediate pulleys 96. Another belt 97 is entrained on a large diameter pulley comprising one of the pair of intermediate pulleys 96 and a shaft pulley of the alternator 30. The size of these pulleys is selected to serve as a speed-increasing transmission so that the rotation of the braking gear 28 is transmitted to the alternator 30 with a proper rotational speed for operation of the alternator. The alternator 30 is of conventional design to generate electrical energy in response to turning of its shaft. As best shown in FIG. 5, a belt tensioning adjustment arm 98 is attached between the case of the alternator 30 and the rear horizontal frame member 83 for selectively adjusting the tension of the belt 97.

The load resister 32 to which the alternator 30 is connected by the cable 31 is mounted to the left horizontal side frame member 80.

Figure 4:
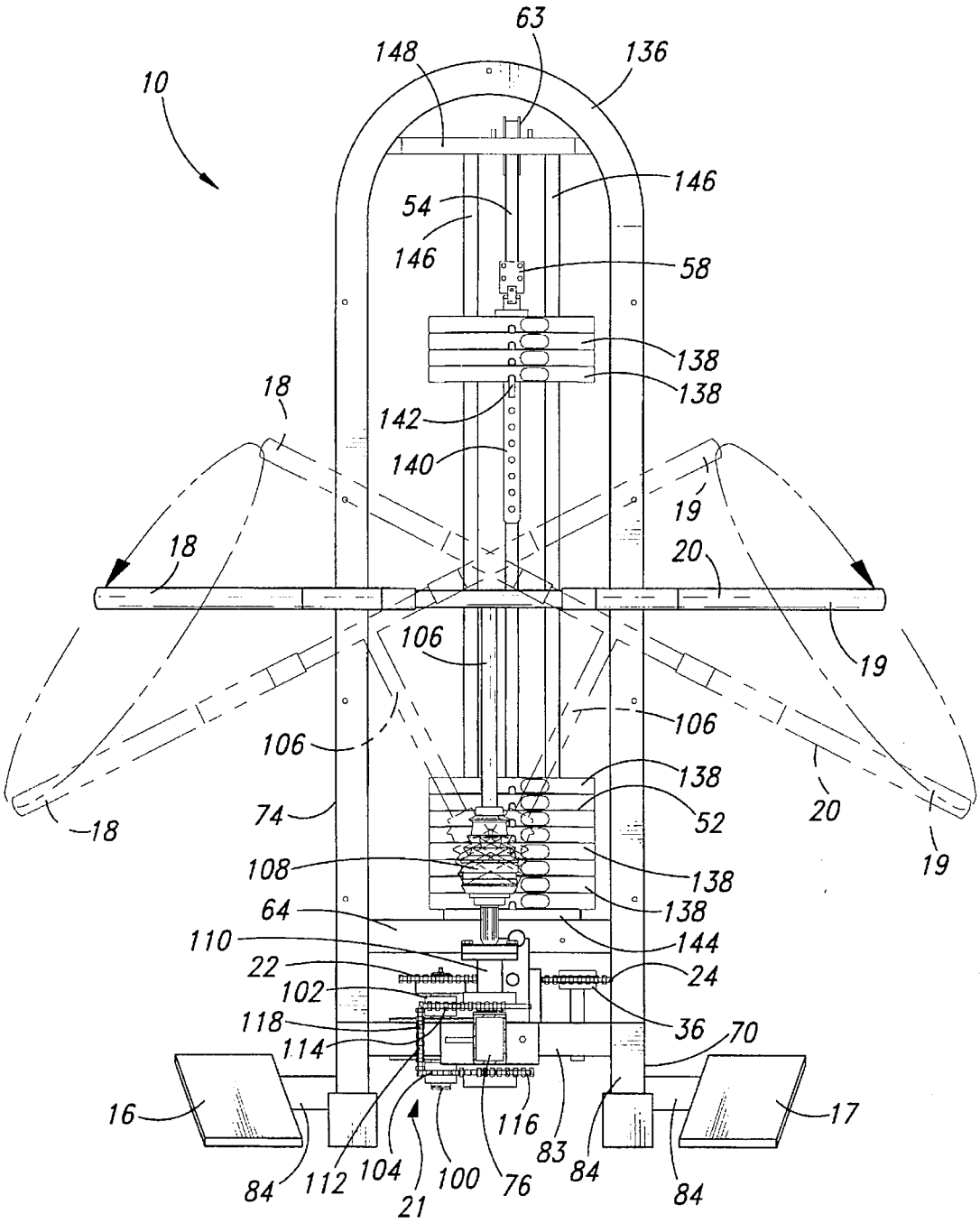
FIG. 4 is an enlarged, rear elevational view of the exercise apparatus of FIG. 1.

As previously discussed, the positive input power applied by the user 12 through the left and right handgrips 18 and 19 of the kayak paddle-like handle 20 is transmitted through the unidirectional clutch assembly 21 to the input drive gear 22. As can be seen in FIG. 4, the unidirectional clutch assembly 21 has a shaft 100 which is rotatably supported by the rear horizontal frame member 83 with the input drive gear 22 rigidly mounted on an upper end of the clutch shaft for rotation therewith. The clutch shaft 100 extends vertically above and below the rear horizontal frame member 83, and has an upper sprocket 102 and a lower sprocket 104. The lower sprocket 104 is mounted on the lower end portion of the clutch shaft and upper sprocket 102 is mounted on the upper end portion of the clutch shaft at a position between the rear horizontal frame member 83 and the input drive gear 22. Each of the upper and lower sprockets 102 and 104 includes a unidirectional clutch bearing by which the sprocket is mounted to the clutch shaft 100.

The kayak paddle-like handle 20 is rigidly attached at a central location between the left and right handgrips 18 and 19 to a post 106 to provide a "T" shaped input handle structure. The post 106 is attached at its lower end through a constant velocity universal joint ("CV" joint") 108 to an upper end of a shaft 110. The shaft 110 is rotatably supported by the horizontal frame member 76 of the rear frame structure 72 at a position between the legs of the user 12 when the user's feet are on the foot pads 16 and 17. The CV joint 108 functions to allow the user 12 to tilt or dip the left and right handgrips 18 and 19 of the kayak paddle-like handle 20 downward from side-to-side and forward and rearward, much in the same manner as when using a kayak paddle to propel a kayak forward or rearward. As the user alternately pulls and pushes the left and right handgrips 18 and 19 rearward and forward to rotate the post 106 clockwise and counterclockwise about its axis, the CV joint 108 transmits this rotation of the post 106 to the shaft 110. Thus, the CV joint 108 allows pivotal movement from side-to-side and forward-to-rearward, while transmitting rotational movement of the post 106 about its axis to the shaft 110. The CV joint 108 is a conventional automotive part used in automotive drive shaft assemblies. A flexible boot covers the CV joint 108.

By the user applying rearward force to one of the left or right handgrips 18 or 19, and at the same time applying a forward force to the other handgrip, the post 106 and shaft 110 connected thereto through the CV joint 108 are rotated with a power stroke. Depending on which of the left and right handgrips is pulled rearward and pushed forward, the rotation of the shaft 110 is counterclockwise or clockwise. If one power stroke is by pulling the left handgrip 18 rearward and pushing the right handgrip 19 forward to produce counterclockwise rotation of the shaft 110 when viewed from above, the next power stroke is achieved by pulling the right handgrip 19 rearward and pushing the left handgrip 18 forward to produce clockwise rotation of the shaft 110 when viewed from above. The result is alternating input power stroke rotation of the shaft 110. This alternating rotation is transmitted to the upper and lower sprockets 102 and 104 mounted on the clutch shaft 100 of the unidirectional clutch assembly 21 by a length of chain 112 having an upper chain portion 114, a lower chain portion 116, and a central chain portion 118 which extends between the upper and lower chain portions, as will be described in detail below. It is noted that the rearward and forward forces applied to the left and right handgrips 18 and 19 by the user need not be equal during a power stroke.

Figure 6:
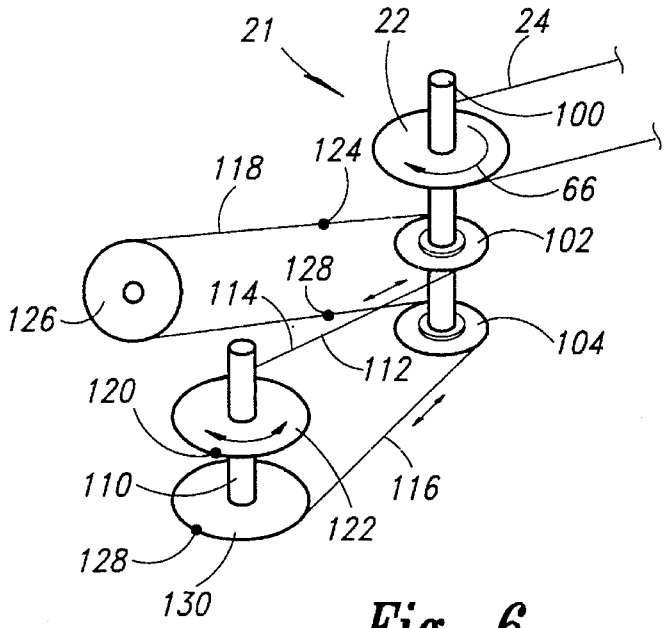
FIG. 6 is an enlarged, fragmentary, isometric view of the input mechanism of the exercise apparatus of FIG. 1.

As best illustrated in FIG. 6, one end of the upper chain portion 114 is fixedly attached at a location 120 on the perimeter of an upper sprocket 122 which is rigidly mounted on the shaft 110 for rotation therewith at a location above the horizontal frame member 76 of the rear frame structure 72. The upper chain portion 114 is entrained on the upper sprocket 122 and extends from the location 120 in a clockwise direction when viewed from above. The upper chain portion 114 wraps partially around the upper sprocket 122 and then extends to the upper sprocket 102 of the unidirectional clutch assembly 21 which is mounted via a unidirectional clutch bearing to the clutch shaft 100. The upper chain portion 114 is entrained on the upper sprocket 102 and starting from the upper sprocket 122 extends forward, then wraps around the upper sprocket 102 in a counterclockwise direction and then extends rearward. When the user 12 pulls rearward on the left handgrips 18 and pushes forward on the right handgrip 19 of the kayak paddle-like handle 20, a counterclockwise rotational force is transmitted from the post 106 through the CV joint 108 to the shaft 110, and the upper sprocket 122 rigidly mounted to the shaft 110 is rotated counterclockwise. This produces a rearward pulling force on the upper chain portion 114 which produces a clockwise rotational force on the upper sprocket 102 when viewed from above. The unidirectional clutch bearing of the upper sprocket 102 is arranged to transmit this clockwise rotational force to the clutch shaft 100 and hence to the input drive gear 22 rigidly mounted thereto to produce clockwise rotation of the input drive gear 22 in the direction of arrow 66.

Rotation of the upper sprocket 122 clockwise and hence the upper sprocket 102 counterclockwise resulting from the user pulling the right handgrip 19 rearward and pushing the left handgrip 18 forward, is not transmitted to the clutch shaft 100 since the unidirectional clutch bearing of the upper sprocket 102 freely overruns in the counterclockwise direction.

The upper chain portion 114 passes around the upper sprocket 102, in the counterclockwise direction as described above, and extends rearwardly. A rearward end of the upper chain portion 114 is connected to a first end of the central chain portion 118 by a twist joint 124. The central chain portion 118 has a link orientation rotated 90° from the upper and lower chain portions 114 and 116. The central chain portion 118 extends rearwardly from the twist joint 124 and passes over and is entrained on an idler sprocket 126 oriented in a vertical plane.

In similar fashion as described above for the upper chain portion 114, the lower chain portion 116 has one end fixedly attached at a location 128 on the perimeter of a lower sprocket 130 which is rigidly mounted on the shaft 110 for rotation therewith at a location below the horizontal frame member 76. The lower chain portion 116 is entrained on the lower sprocket 130 and extends from the location 128 in a counterclockwise direction when viewed from above. The lower chain portion 116 wraps partially around the lower sprocket 130 and then extends to the lower sprocket 104 of the unidirectional clutch assembly 21 which is mounted via a unidirectional clutch bearing to the clutch shaft 100. The lower chain portion 116 is entrained on the lower sprocket 104 and starting from the lower sprocket 130 extends forward, then wraps around the lower sprocket 104 in a counterclockwise direction and then extends rearward. When the user 12 pulls rearward on the right handgrip 19 and pushes forward on the left handgrip 18 of the kayak paddle-like handle 20, a clockwise rotational force is transmitted from the post 106 through the CV joint 108 to the shaft 110, and the lower sprocket 130 rigidly mounted to the shaft 110 is rotated clockwise. This produces a rearward pulling force on the lower chain portion 116 which produces a clockwise rotational force on the lower sprocket 104 when viewed from above. The unidirectional clutch bearing of the lower sprocket 104 is arranged to transmit this clockwise rotational force to the clutch shaft 100 and hence to the input drive gear 22 rigidly mounted thereto to produce clockwise rotation of the input drive gear 22 in the direction of arrow 66.

Rotation of the lower sprocket 130 counterclockwise and hence the lower sprocket 104 counterclockwise resulting from the user pulling the left handgrip 18 rearward and pushing the right handgrip 19 forward, is not transmitted to the clutch shaft 100 since the unidirectional clutch bearing of the lower sprocket 104 freely overruns in the counterclockwise direction.

The lower chain portion 116 passes around the lower sprocket 104, in the counterclockwise direction as described above, and extends rearwardly. A rearward end of the lower chain 116 is connected to a second end of the central chain portion 118 by a twist joint 128. The central chain portion 118 extends rearwardly from the twist joint 128 and passes under and is entrained on the idler sprocket 126, as described above. The idler sprocket 126 is rotatably supported in the vertical plane by a bracket 130 (see FIG. 5) which is pulled rearwardly by a tensioning spring 132 extending between the bracket 130 and an attachment plate 134 (see FIG. 1) fixedly attached to the rear frame structure 72 to maintain proper tension on the chain.

With this arrangement, rearward pulling on either the left or right handgrip 18 or 19, and simultaneous forward pushing on the other handgrip produces clockwise rotation in the direction of arrow 66 of the input drive gear 22. This supplies the user input power previously discussed which drives the chain 24.

When commencing an exercise, the speed of the braking gear 28 and the alternator 30 connected thereto will be zero, below the selected constant braking velocity for the exercise. Thus, the alternator 30 will initially not apply any braking force to the braking gear 28 and the input power applied by the user 12 will be translated almost completely into increasing the speed with which the chain 24 travels along its endless loop, and little resistance is encountered by the user on the left and right handgrips 18 and 19.

When the speed of the chain 24, and hence the braking gear 28 on which the chain 24 is entrained, increases to just over the selected constant braking velocity, the alternator 30 will have a load applied to it (with the load being removed only when the velocity drops below the user-selected braking velocity), thus applying a negative braking power to the chain as necessary to maintain the speed of the braking gear at the selected constant braking velocity. When the braking power is first applied, the weight 52 will begin to lift in the manner described previously until the user 12 adjusts the user-selected velocity of the input power being input to the apparatus 10 through pulling and pushing of the left and right handgrips 18 and 19 to rotate the shaft 110 and the clutch shaft 100. The upward movement of the weight 52 will cease and the weight will remain suspended above the rest 64 at the desired elevation when and for so long as the user-selected input velocity is equal to the selected constant braking velocity. If the handgrips 18 and 19 are repetitively pulled/pushed too quickly, the weight 52 will start to rise, and if repetitively pulled/pushed too slowly, the weight will start to fall.

During operation, the user 12 cannot affect the exercise force component of the input power being applied by operation of the handgrips 18 and 19, since this exercise force is held constant and is almost solely a function of the mass selected for the weight 52 to be used for the exercise and which is to be held in the stationary suspended position. Preferably, little upward or downward movement of the weight 52 occurs during the exercise. If the user should increase the input power being applied via the handgrips 18 and 19, substantially the only result is increasing the exercise velocity, not the exercise force (the mass of the weight selected primarily determines this exercise force and the mass stays constant throughout the exercise). Thus, the increased input power can only be produced by increased exercise velocity (Power=Force×Velocity), and causes upward movement of the weight 52 until the user readjusts the exercise velocity and hence decreases the input power so that the exercise velocity will again match the selected constant braking velocity and the weight 52 will again assume a stationary elevated position.

It is noted that as in any system a power balance must occur, with the input power equaling the braking power. Since the exercise force and the braking force are opposing each other and together balance against the weight/resistance force of the weight 52 to maintain the weight in a stationary suspended state by the trolley 44 riding on the chain 24, the exercise force and the braking force cancel each other (i.e., in the stationary condition $^{F}IN \times {}^{V}IN = {}^{F}BR \times {}^{V}BR$, thus $^{V}IN = {}^{V}BR$). Any imbalance between the input velocity and the braking velocity will result in an upward or downward velocity of the weight 52.

It is also noted that as long as the weight 52 is elevated above the rest 64, even if the user 12 stops applying input power and the weight is falling, the alternator 30 and hence the braking gear 28 will be regulated to maintain the selected constant braking velocity.

The left and right handgrips 18 and 19 are shown in FIGS. 2, 3 and 4 in phantom line to illustrate their range of movement. During exercise, when sufficient force is applied by the hands of the user 12 to the left and right handgrips 18 and 19, the force produces corresponding counterclockwise or clockwise rotation of the upper and lower sprockets 122 or 130 mounted on the shaft 110. This rotational movement is transmitted through the upper or lower chain portion 114 or 116 to a corresponding one of the upper or lower sprockets 102 or 104. The rotational movement transmitted by the upper and lower chain portions 114 and 116 to the upper and lower sprockets 102 and 104 as a result of the movement of the left and right handgrips 18 and 19 of the kayak paddle-like handle 20 is converted into clockwise rotation of the clutch shaft 100 by the unidirectional clutch assembly 21. This rotational force is transmitted through the clutch shaft 100 to the input drive gear 22 to provide the input power to the chain 24 in the direction of arrow 66.

It is noted that the movement of the left and right handgrips 18 and 19 never produces counterclockwise rotation of the clutch shaft 100 because the clutch bearings positioned between the upper and lower sprockets 102 and 104 and the clutch shaft allow the sprockets to turn freely on the clutch shaft in the counterclockwise direction without transmitting rotation to the clutch shaft. The clutch bearings only transmit clockwise rotation of the upper and lower sprockets 102 and 104 to the clutch shaft 100.

The front frame structure 74 includes an inverted U-shaped frame member 136 fixedly attached to an upper side thereof and projecting upward from the base frame structure 70 at a position generally above the braking gear 28 and the idler gear 40. The rest 64 extends between the vertical posts of the U-shaped frame member 136. As previously described, when the weight 52 is in a lowered rest position, the weight rests upon the rest 64.

The weight 52 comprises a stack of individual weights 138 which can be selectively attached together using a lifting rod 140 to vary the size of the weight stack being lifted using a selector pin 142 in a conventional manner. The lifting rod 140 has its upper end attached to the one end 58 of the strap 54, which, as described above, passes over the idler pulley 60 carried by the trolley 44 and the idler pulleys 62 and 63 to cause the weight 52 to be lifted and lowered as the trolley 44 is moved rearward and forward, respectively. When the weight 52 is in the rest position on the rest 64, the user 12 may remove the selector pin 142 and reinsert the selector pin through a lateral bore provided in each of the individual weights 138. The selector pin 142 has a sufficient length to extend through the bore in the individual weight and engage a corresponding bore hole in the lifting rod 140. In such manner, all of the individual weights 138 above and including the individual weight which receives the selector pin 142 will be lifted and lowered as a result of the trolley 44 transmitting its movement through the strap 54 to the lifting rod 140. The individual weights 138 which are located below the individual weight that receives the selector pin 142 will remain at rest on the rest 64. Each of the individual weights 138 has a central aperture through which the lifting rod 140 extends.

With use of a selectable weight stack to form the weight 52 to be lifted, the user can select ones of the individual weights 138 to be locked together and thereby select the magnitude of the constant exercise force the user will encounter when exercising using the apparatus 10. It is noted that the adjustment of the weight stack to change the number of the individual weights 138 being lifted, and hence the exercise force is independent of the constant braking velocity selected by the user 12 for the braking force. A selected number of the uppermost individual weights 138 may be permanently locked together to provide a minimum required resistance force.

A resilient cushion 144 is positioned on the rest 64 to cushion the engagement of the weight 52 as it moves downward into contact with the rest, either directly or through however many of the individual weights 138 remain on the rest when the remainder of the weight stack is being lifted. To guide the individual weights 138 as they are moved upward and downward as part of the weight stack, a pair of guide rods 146 are connected between the rest 64 and a support plate 148 fixedly attached to the upper end portion of the U-shaped frame member 136. A corresponding pair of through holes are provided in each of the individual weights 138 to slideably receive the guide rods 146.

As previously described, the magnitude of the braking force applied by the alternator 30 and the switching of the load to the alternator is controlled by a conventional feedback servo loop. The selection of the selected constant velocity for the braking velocity of the braking gear 28 is accomplished using a control panel 148 mounted on a cover 150, both shown in phantom line in FIGS. 2 and 3. The control panel 148 is positioned for easy viewing and manual operation by the user 12 when the user is sitting on the seat 14. The control panel 148 is connected to the alternator 30 through a cable (not shown). Circuitry (not shown) is contained within the control panel 148 for presenting a visual display to the user 12 and also providing means for the user to select parameters and options, and input data used by a microprocessor and computer storage means (not shown) mounted within the control panel to run computer-based programs which facilitate operation of the apparatus 10. Conventional circuitry and programming techniques are used.

In addition to allowing the user 12 to select and adjust the magnitude of the selected constant braking velocity of the braking power, the control panel 148 also allows the user the option to select one of a series of pre-programmed exercise programs. The exercise programs each have a pre-stored series of constant braking velocities for the braking power and an associated timing sequence by which the control panel will vary the selected constant braking velocity. In such manner, one selected portion of the user's exercise time will have one selected constant braking velocity and one or more other selected portions of the user's exercise time will have one or more different other selected constant braking velocities according to a predetermined pattern. This produces a more effective exercise sequence. It is noted that these changes only apply to varying the braking velocity component of the braking power and hence the user-selected input velocity component of the input power, since the exercise force component of the input power is determined almost completely by the number of the individual weights 124 selected to make up the weight 52 to be lifted. As such, it should be noted that with the apparatus 10 of the present invention the selected constant braking velocity can be selectively adjusted by the user independent of the mass of the weight 52.

While manual adjustment of the weight 52 by adding or deleting ones of the individual weights 138 is required to adjust the exercise force component, the control panel can provide visual and audible prompts to the user 12 to suggest adding or decreasing the mass of the weight 52 to improve the exercise being conducted.

The apparatus 10 operates at a constant apparatus velocity and load, and produces very constant and reproducible exercise velocity and load from one exercise cycle to the next and at any point in the travel of the handgrips 18 and 19. It is noted that if desired, the control panel 148 and the associated brake speed control circuitry may be designed to allow selection of a braking velocity that is not constant, but rather varies during a selected portion of the exercise program.

Figure 7:
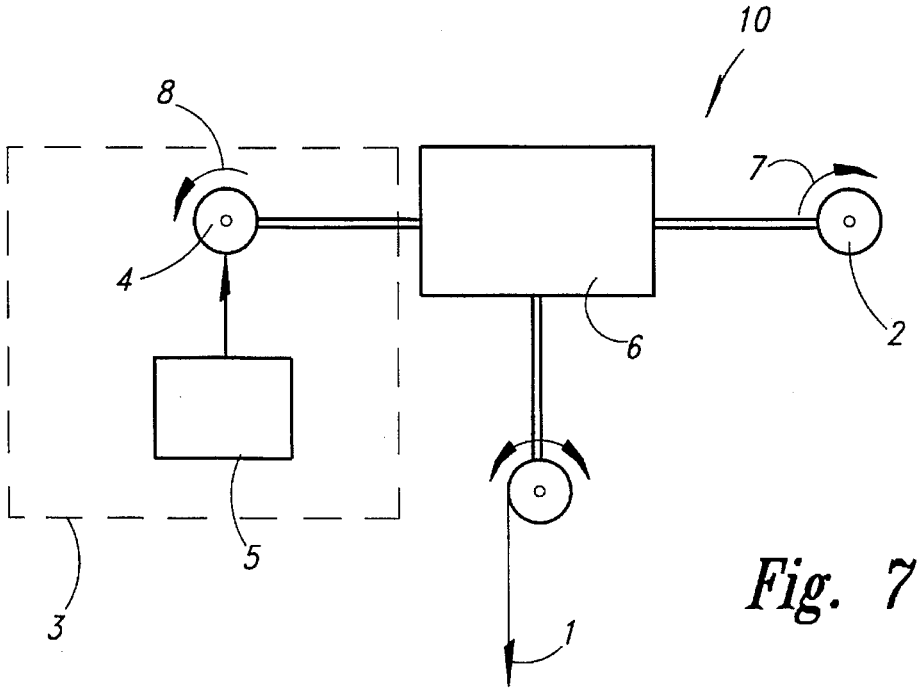
FIG. 7 is a functional block diagram of the exercise apparatus of FIG. 1.

It is noted that while differential 6 shown in FIG. 7 and the illustrated preferred embodiment of the invention uses the trolley 44 suspended on the chain 24, other differentials may be used, such as a conventional differential gear arrangement or a ball screw arrangement. In similar manner, while the resistance force 1 shown in FIG. 7 takes the form of the weight 52 in the illustrated preferred embodiment of the invention, the resistance force may be supplied by a spring, motor or other resistance member.

It will be appreciated that, although a specific embodiment of the invention has been described herein for purposes of illustration, various modifications may be made without departing from the spirit and scope of the invention. Accordingly, the invention is not limited except as by the appended claims.

We claim:

1. An exercise apparatus, comprising:

a vertically movable weight;

an input mechanism having an input member engageable by at least one limb of a user and moveable to input a positive input power with a unidirectional exercise force at a user-selected velocity for moving the weight upward;

a brake applying a negative braking power with a unidirectional braking force opposing the exercise force, the braking power having a braking velocity for permitting downward movement of the weight;

a brake controller controlling the application of the brake to maintain a selected braking velocity for at least a selected portion of the user's exercise time; and a differential member coupled to the weight and receiving the input power from the input mechanism and the braking power from the brake, the differential member determining a differential between the user-selected velocity and the selected braking velocity, and applying the resultant to the weight so that if the user-selected velocity is greater than the selected braking velocity the weight is lifted, and if the user-selected velocity is less than the selected braking velocity the weight is lowered, whereby the user during at least the selected portion of the user's exercise time can move the input member to apply input power to lift the weight to a desired elevation and maintain the weight at about the desired elevation by applying input power with the user-selected velocity substantially matching the selected braking velocity.

2. The apparatus of claim 1 wherein the selected braking velocity is a constant velocity.

3. The apparatus of claim 1 wherein the input member includes a rotatably mounted handle rotatable by the user to input the input power.

4. The apparatus of claim 3 wherein the handle is mounted to allow lateral tilting thereof by the user while being rotated to input the input power.

5. The apparatus of claim 3 wherein the handle is rotatable by the user in both clockwise and counterclockwise directions to input the input power, and the input mechanism further includes a converter to convert user input clockwise and counterclockwise rotational input power into the unidirectional exercise force.

6. The apparatus of claim 5 wherein the converter includes a unidirectional drive assembly to sum the clockwise and counterclockwise rotational input power into unidirectional rotational input power, the unidirectional drive assembly being coupled to the differential member to transmit the unidirectional input power thereto.

7. The apparatus of claim 3 wherein the handle is coupled to a rotatable member through a converter which converts user movement of the handle into unidirectional rotation of the rotatable member, the rotatable member being coupled to the differential member to transfer the input power with the unidirectional rotation to the differential member.

8. The apparatus of claim 3 wherein the handle is pivotally coupled to a rotatable shaft to permit lateral pivotal movement relative thereto while transmitting rotational movement of the handle to the rotatable shaft, the rotatable shaft being coupled to the differential member to transfer the rotational input power applied to the handle by the user to the differential member.

9. The apparatus of claim 8 wherein the handle is coupled to the rotatable shaft by a universal joint.

10. The apparatus of claim 8 wherein the handle is coupled to the rotatable shaft to transmit both clockwise and counterclockwise rotational movement thereto, and the apparatus further includes a unidirectional drive assembly to sum the clockwise and counterclockwise rotational movement of the rotatable shaft into a unidirectional rotational direction, the drive assembly being coupled to transfer the rotational input power applied to the handle by the user to the differential member in the unidirectional rotation direction.

11. The apparatus of claim 1, further including a flexible member interconnecting the input mechanism, the brake and the differential member to transmit the input power and the braking power to the differential member.

12. The apparatus of claim 11 wherein the differential member includes a movable trolley with the weight coupled thereto so that movement of the trolley in a first direction lifts the weight and movement of the trolley in a second direction lowers the weight, the trolley being supported by the flexible member to produce movement of the trolley in the first direction if the user-selected velocity is greater than the selected braking velocity, and to produce movement of the trolley in the second direction if the user-selected velocity is less than the selected braking velocity.

13. The apparatus of claim 12 wherein the flexible member is an endless loop operatively engaged by the brake to transmit the braking power thereto and by the input mechanism to transmit the input power thereto, the flexible member including a first length extending between the brake and the input mechanism, the trolley being suspended on the first length.

14. The apparatus of claim 13 wherein the trolley includes a first idler riding on the flexible member and by which the trolley is suspended on the first length thereof, and a second idler over which a return second length of the flexible member extends, the second length extending between the brake and the input mechanism, whereby slack in the endless loop is avoided as the trolley moves between the first and second directions.

15. The apparatus of claim 11 wherein the flexible member has first, second and third lengthwise portions, the first portion of the flexible member extending between the brake and the input mechanism, the differential member including a first rotatable member around which the first portion of the flexible member is engaged to move the first rotatable member in differing first and second directions in response to shortening and lengthening of the first portion of the flexible member, the weight being coupled to the first rotatable member for upward movement in response to movement of the first rotatable member in one of the first and second directions and downward movement in response to movement of the first rotatable member in the other of the first and second directions, the brake including a second rotatable member around which the second portion of the flexible member is engaged with the negative braking power being applied to the second portion of the flexible member, and the input mechanism including a third rotatable member around which the third portion of the flexible member is engaged with the positive input power being applied to the third portion of the flexible member, the flexible member transmitting the positive input power and the negative braking power to the differential member while being moved in a unidirection along a path of movement between the second and third rotatable members.

16. The apparatus of claim 15 wherein the flexible member further includes a fourth lengthwise portion extending between the second and third portions of the flexible member such that the flexible member forms an endless loop.

17. The apparatus of claim 11 wherein the flexible member has first, second and third lengthwise portions, the first portion of the flexible member extending between the brake and the input mechanism, the differential member including a rotatable member around which the first portion of the flexible member is engaged to move the first rotatable member in differing first and second directions in response to shortening and lengthening of the first portion of the flexible member, the weight being coupled to the first rotatable member for upward movement in response to movement of the first rotatable member in one of the first and second directions and downward movement in response to movement of the first rotatable member in the other of the first and second directions, the brake applying the negative braking power to the second portion of the flexible member, and the input mechanism applying the positive input power to the third portion of the flexible member.

18. The apparatus of claim 1, further including an adjustment member selectively adjustable by the user to select the selected braking velocity of the braking power applied by the brake.

19. The apparatus of claim 18 wherein the selected braking velocity is selectively adjustable by the user independent of the mass of the weight.

20. The apparatus of claim 18 wherein the weight comprises a stack of individual weights and a selectively operable lock to permit the user to lock selected ones of the individual weights together to form the weight, and wherein the adjustment member allows the user to select the selected braking velocity of the braking power applied by the brake independent of the number of the individual weights the user selects to lock together.

21. The apparatus of claim 1 wherein the weight is a stack of individual weights selectively locked together to permit the user to selectively vary the number of individual weights comprising the weight coupled to the differential member.

22. The apparatus of claim 1 wherein the selected braking velocity of the braking power applied by the brake is selectively adjustable during the user's exercise time to vary the selected braking velocity during the selected portion of the user's exercise time from the selected braking velocity during at least one or more other selected portions of the user's exercise time according to a predetermined pattern.

23. The apparatus of claim 1, further including an endless loop of chain operatively engaged by the input mechanism and the brake, and operatively engaging the differential member to transmit the input power and the braking power to the differential member.

24. The apparatus of claim 1 wherein the brake includes an alternator operating in conjunction with a load resistor, the rotational speed of the alternator determining the braking velocity of the braking power applied by the brake, and the brake controller includes a feedback loop monitoring the speed of the alternator and controlling the load on the alternator, to control the rotational speed of the alternator.

25. The apparatus of claim 1, further including a flexible member extending between and operatively engaging the brake and the differential member to transmit the braking power therebetween, and extending between and operatively engaging the input mechanism and the differential member to transmit the input power therebetween, and wherein the brake includes a rotatable brake member around which the flexible member is engaged so that the flexible member is fed to the differential member at a feed rate by the rotation of the rotatable brake member during at least the selected portion of the user's exercise time and the input mechanism includes a rotatable input member around which the flexible member is engaged so that the flexible member is drawn away from the differential member at a draw rate determined by the rotational speed of the rotatable input member.

26. An exercise apparatus, comprising:

a vertically movable weight;

an input mechanism having an input member engageable by at least one limb of a user and moveable to input an input power with a unidirectional exercise force at a user-selected velocity for moving the weight upward;

a speed control applying an apparatus controlled power with a unidirectional apparatus force opposing the exercise force, the apparatus controlled power having a selected velocity for permitting downward movement of the weight, the speed control applying the apparatus controlled power at the selected velocity for at least a selected portion of the user's exercise time; and a differential member coupled to the weight and receiving the input power from the input mechanism and the apparatus controlled power from the speed control, the differential member determining a differential between the user-selected velocity and the selected velocity, and applying the resultant to the weight so that if the user-selected velocity is greater than the selected velocity the weight is lifted, and if the user-selected velocity is less than the selected velocity the weight is lowered, whereby the user during at least the selected portion of the user's exercise time can move the input member to apply input power to lift the weight to a desired elevation and maintain the weight at about the desired elevation by applying input power with the user-selected velocity substantially matching the selected velocity.

27. The apparatus of claim 26 wherein the selected speed control velocity is a constant velocity.

28. The apparatus of claim 26 wherein the input member includes a rotatably mounted handle rotatable by the user to input the input power.

29. The apparatus of claim 28 wherein the handle is mounted to allow lateral tilting thereof by the user while being rotated to input the input power.

30. The apparatus of claim 28 wherein the handle is rotatable by the user in both clockwise and counterclockwise directions to input the input power, and the input mechanism further includes a converter to convert user input clockwise and counterclockwise rotational input power into the unidirectional exercise force.

31. The apparatus of claim 30 wherein the converter includes a unidirectional drive assembly to sum the clockwise and counterclockwise rotational input power into unidirectional rotational input power, the unidirectional drive assembly being coupled to the differential member to transmit the unidirectional input power thereto.

32. The apparatus of claim 28 wherein the handle is coupled to a rotatable member through a converter which converts user movement of the handle into unidirectional rotation of the rotatable member, the rotatable member being coupled to the differential member to transfer the input power with the unidirectional rotation to the differential member.

33. The apparatus of claim 28 wherein the handle is pivotally coupled to a rotatable shaft to permit lateral pivotal movement relative thereto while transmitting rotational movement of the handle to the rotatable shaft, the rotatable shaft being coupled to the differential member to transfer the rotational input power applied to the handle by the user to the differential member.

34. The apparatus of claim 33 wherein the handle is coupled to the rotatable shaft by a universal joint.

35. The apparatus of claim 33 wherein the handle is coupled to the rotatable shaft to transmit both clockwise and counterclockwise rotational movement thereto, and the apparatus further includes a unidirectional drive assembly to sum the clockwise and counterclockwise rotational movement of the rotatable shaft into a unidirectional rotational direction, the drive assembly being coupled to the differential member to transfer the rotational input power applied to the handle by the user to the differential member in the unidirectional rotation direction.

36. The apparatus of claim 26, further including a flexible member interconnecting the input mechanism, the speed control and the differential member to transmit the input power and the apparatus controlled power to the differential member.

37. The apparatus of claim 36 wherein the differential member includes a movable trolley with the weight coupled thereto so that movement of the trolley in a first direction lifts the weight and movement of the trolley in a second direction lowers the weight, the trolley being engaged by the flexible member to produce movement of the trolley in the first direction if the user-selected velocity is greater than the selected velocity, and to produce movement of the trolley in the second direction if the user-selected velocity is less than the selected velocity.

38. The apparatus of claim 37 wherein the flexible member is an endless loop operatively engaged by the speed control to transmit the apparatus controlled power thereto and by the input mechanism to transmit the input power thereto, the flexible member including a first length extending between the speed control and the input mechanism, the trolley engaging the first length.

39. The apparatus of claim 36 wherein the flexible member has first, second and third lengthwise portions, the first portion of the flexible member extending between the speed control and the input mechanism, the differential member including a first rotatable member around which the first portion of the flexible member is engaged to move the first rotatable member in differing first and second directions in response to shortening and lengthening of the first portion of the flexible member, the weight being coupled to the first rotatable member for upward movement in response to movement of the first rotatable member in one of the first and second directions and downward movement in response to movement of the first rotatable member in the other of the first and second directions, the speed control including a second rotatable member around which the second portion of the flexible member is engaged with the apparatus-controlled power being applied to the second portion of the flexible member, and the input mechanism including a third rotatable member around which the third portion of the flexible member is engaged with the input power being applied to the third portion of the flexible member, the flexible member transmitting the input power and the apparatus-controlled power to the differential member while being moved in a unidirection along a path of movement between the second and third rotatable members.

40. The apparatus of claim 39 wherein the flexible member further includes a fourth lengthwise portion extending between the second and third portions of the flexible member such that the flexible member forms an endless loop.

41. The apparatus of claim 36 wherein the flexible member has first, second and third lengthwise portions, the first portion of the flexible member extending between the speed control and the input mechanism, the differential member including a rotatable member around which the first portion of the flexible member is engaged to move the first rotatable member in differing first and second directions in response to shortening and lengthening of the first portion of the flexible member, the weight being coupled to the first rotatable member for upward movement in response to movement of the first rotatable member in one of the the first and second directions and downward movement in response to movement of the first rotatable member in the other of the first and second directions, the speed control applying the apparatus-controlled power to the second portion of the flexible member, and the input mechanism applying the input power to the third portion of the flexible member.

42. The apparatus of claim 26, further including an adjustment member selectively adjustable by the user to select the selected velocity of the apparatus controlled power applied by the speed control.

43. The apparatus of claim 42 wherein the selected velocity is selectively adjustable by the user independent of the mass of the weight.

44. The apparatus of claim 42 wherein the weight comprises a stack of individual weights and a selectively operable lock to permit the user to lock selected ones of the individual weights together to form the weight, and wherein the adjustment member allows the user to select the selected velocity of the apparatus controlled power applied by the speed control independent of the number of the individual weights the user selects to lock together.

45. The apparatus of claim 26 wherein the weight is a stack of individual weights selectively locked together to permit the user to selectively vary the number of individual weights comprising the weight coupled to the differential member.

46. The apparatus of claim 26 wherein the selected velocity of the apparatus controlled power applied by the speed control is selectively adjustable during the user's exercise time to vary the selected velocity during the selected portion of the user's exercise time from the selected velocity during at least one or more other selected portions of the user's exercise time according to a predetermined pattern.

47. The apparatus of claim 26, further including a flexible member extending between and operatively engaging the speed control and the differential member to transmit the apparatus controlled power therebetween, and extending between and operatively engaging the input mechanism and the differential member to transmit the input power therebetween, and wherein the speed control includes a rotatable control member around which the flexible member is engaged so that the flexible member is fed to the differential member at a feed rate by the rotation of the rotatable control member during at least the selected portion of the user's exercise time and the input mechanism includes a rotatable input member around which the flexible member is engaged so that the flexible member is drawn away from the differential member at a draw rate determined by the rotational speed of the rotatable input member.

48. An exercise apparatus, comprising:

a vertically movable weight;

an endless loop of a flexible member;

an input mechanism engaged by the user to input an input power with a unidirectional exercise force at a user-selected velocity, the input power being applied to the flexible member at an input position along the endless loop for lifting the weight;

a speed control applying an apparatus controlled power with a unidirectional apparatus force opposing the exercise force, the apparatus controlled power having a selected velocity, the apparatus controlled power being applied to the flexible member at a speed control position along the endless loop to limit the speed of the flexible member at the speed control position for permitting lowering of the weight, the speed control applying the apparatus controlled power at the selected velocity for at least a selected portion of the user's exercise time; and a differential member coupled to the weight and engaging a first length of the flexible member as it extends between the input position and the speed control position, the flexible member transmitting the input power from the input mechanism to the differential member and the apparatus controlled power from the speed control to the differential member, the differential member determining a differential between the user-selected velocity and the selected velocity, and applying the resultant to the weight so that if the user-selected velocity is greater than the selected velocity the weight is lifted, and if the user-selected velocity is less than the selected velocity the weight is lowered, whereby the user during at least the selected portion of the user's exercise time can apply input power to lift the weight to a desired elevation and maintain the weight at about the desired elevation by applying input power with the user-selected velocity substantially matching the selected velocity.

49. The apparatus of claim 48 wherein the selected speed control velocity is selected as a constant velocity.

50. The apparatus of claim 48 wherein the differential member includes a movable trolley coupled to the weight so that movement of the trolley in a first direction lifts the weight and movement of the trolley in a second direction lowers the weight, the trolley being engaged by the flexible member to produce movement of the trolley in the first direction if the user-selected velocity is greater than the selected velocity, and to produce movement of the trolley in the second direction if the user-selected velocity is less than the selected velocity.

51. The apparatus of claim 50 wherein the trolley includes a first idler riding on the flexible member, and a second idler over which a return second length of the flexible member extends, the second length extending between the input position and the speed control position, whereby slack in the endless loop is avoided as the trolley moves between the first and second directions.

52. The apparatus of claim 48, further including an adjustment member selectively adjustable by the user to select the selected velocity of the apparatus controlled power applied by the brake.

53. The apparatus of claim 52 wherein the selected velocity is selectively adjustable by the user independent of the mass of the weight.

54. The apparatus of claim 52 wherein the weight comprises a stack of individual weights and a selectively operable lock to permit the user to lock selected ones of the individual weights together to form the weight, and wherein the adjustment member allows the user to select the selected velocity of the apparatus controlled power applied by the speed control independent of the number of the individual weights the user selects to lock together.

55. The apparatus of claim 48 wherein the weight is a stack of individual weights selectively locked together to permit the user to selectively vary the number of individual weights comprising the weight coupled to the differential member.

56. The apparatus of claim 48 wherein the selected velocity of the apparatus controlled power applied by the speed control is selectively adjustable during the user's exercise time to vary the selected velocity during the selected portion of the user's exercise time from the selected velocity during at least one or more other selected portions of the user's exercise time according to a predetermined pattern.

57. The apparatus of claim 48 wherein the differential member includes a first rotatable member around which the first length of the flexible member is engaged for reciprocal movement of the first rotatable member in response to shortening and lengthening of the first length of the flexible member, the weight being coupled to the first rotatable member for movement therewith, the speed control including a second rotatable member positioned at the speed control position and around which the first length of the flexible member is engaged with the apparatus-controlled power being applied to the first length of the flexible member by the second rotatable member, and the input mechanism including a third rotatable member positioned at the input position and around which the first length of the flexible member is engaged with the input power being applied to the first length of the flexible member by the third rotatable member, the flexible member transmitting the input power and the apparatus-controlled power to the differential member while being moved in a unidirection along a path of movement between the second and third rotatable members.

58. The apparatus of claim 48 wherein the differential member includes a rotatable member around which the first length of the flexible member is engaged for reciprocal movement of the first rotatable member in response to shortening and lengthening of the first length of the flexible member, the weight being coupled to the first rotatable member for movement therewith.

59. The apparatus of claim 48 wherein the input mechanism includes a handle engageable by at least one hand of the user and moveable to input the input power.

60. The apparatus of claim 59 wherein the handle is coupled to a rotatable member engaging the flexible member at the input position and the input mechanism further includes a converter which converts user movement of the handle into unidirection rotation of the rotatable member to drive the flexible member in a unidirection along a path of movement.

61. The apparatus of claim 59 wherein the handle is rotatable mounted for rotation by the user to input the input power.

62. The apparatus of claim 61 wherein the handle is mounted to allow lateral tilting thereof by the user while being rotated to input the input power.

63. The apparatus of claim 61 wherein the handle is rotatable by the user in both clockwise and counterclockwise directions to input the input power, and the input mechanism further includes a converter to convert user input clockwise and counterclockwise rotational input power into the unidirectional exercise force.

64. The apparatus of claim 63 wherein the converter includes a unidirectional drive assembly to sum the clockwise and counterclockwise rotational input power into unidirectional rotational input power, the unidirectional drive assembly being coupled to the differential member to transmit the unidirectional input power thereto.

65. The apparatus of claim 59 wherein the handle is coupled to a rotatable member through a converter which converts user movement of the handle into unidirectional rotation of the rotatable member, the rotatable member being coupled to the differential member to transfer the input power with the unidirectional rotation to the differential member.

66. The apparatus of claim 59 wherein the handle is pivotally coupled to a rotatable shaft to permit lateral pivotal movement relative thereto while transmitting rotational movement of the handle to the rotatable shaft, the rotatable shaft being coupled to the differential member to transfer the rotational input power applied to the handle by the user to the differential member.

67. The apparatus of claim 66 wherein the handle is coupled to the rotatable shaft by a universal joint.

68. The apparatus of claim 66 wherein the handle is coupled to the rotatable shaft to transmit both clockwise and counterclockwise rotational movement thereto, and the apparatus further includes a unidirectional drive assembly to sum the clockwise and counterclockwise rotational movement of the rotatable shaft into a unidirectional rotational direction, the drive assembly being coupled to the differential member to transfer the rotational input power applied to the handle by the user to the differential member in the unidirectional rotation direction.

69. An exercise apparatus, comprising:

a connector member;

a resistance member applying a resistance force to the connector member in a first direction;

an input mechanism having an input member engageable by at least one limb of a user and moveable to input a positive input power with a unidirectional exercise force at a user-selected velocity for moving the connector member in a second direction generally opposite the first direction;

a brake applying a negative braking power with a unidirectional braking force opposing the exercise force, the braking power having a braking velocity for permitting movement of the connector member in the first direction;

a brake controller controlling the application of the brake to maintain a selected braking velocity for at least a selected portion of the user's exercise time; and a differential member coupled to the connector member and receiving the input power from the input mechanism and the braking power from the brake, the differential member determining a differential between the user-selected velocity and the selected braking velocity, and applying the resultant to the connector member so that if the user-selected velocity is greater than the selected braking velocity the connector member is moved in the second direction, and if the user-selected velocity is less than the selected braking velocity the connector member is moved in the first direction.

70. The apparatus of claim 69 wherein the selected braking velocity is a constant velocity.

71. The apparatus of claim 69 wherein the input member includes a rotatably mounted handle rotatable by the user to input the input power.

72. The apparatus of claim 71 wherein the handle is mounted to allow lateral tilting thereof by the user while being rotated to input the input power.

73. The apparatus of claim 71 wherein the handle is rotatable by the user in both clockwise and counterclockwise directions to input the input power, and the input mechanism further includes a converter to convert user input clockwise and counterclockwise rotational input power into the unidirectional exercise force.

74. The apparatus of claim 73 wherein the converter includes a unidirectional drive assembly to sum the clockwise and counterclockwise rotational input power into unidirectional rotational input power, the unidirectional drive assembly being coupled to the differential member to transmit the unidirectional input power thereto.

75. The apparatus of claim 71 wherein the handle is coupled to a rotatable member through a converter which converts user movement of the handle into unidirectional rotation of the rotatable member, the rotatable member being coupled to the differential member to transfer the input power with the unidirectional rotation to the differential member.

76. The apparatus of claim 71 wherein the handle is pivotally coupled to a rotatable shaft to permit lateral pivotal movement relative thereto while transmitting rotational movement of the handle to the rotatable shaft, the rotatable shaft being coupled to the differential member to transfer the rotational input power applied to the handle by the user to the differential member.

77. The apparatus of claim 76 wherein the handle is coupled to the rotatable shaft by a universal joint.

78. The apparatus of claim 76 wherein the handle is coupled to the rotatable shaft to transmit both clockwise and counterclockwise rotational movement thereto, and the apparatus further includes a unidirectional drive assembly to sum the clockwise and counterclockwise rotational movement of the rotatable shaft into a unidirectional rotational direction, the drive assembly being coupled to the differential member to transfer the rotational input power applied to the handle by the user to the differential member in the unidirectional rotation direction.

79. The apparatus of claim 69, further including a flexible member interconnecting the input mechanism, the brake and the differential member to transmit the input power and the braking power to the differential member.

80. The apparatus of claim 79 wherein the differential member includes a movable trolley coupled to the resistance member though the connector member, the trolley being engaged by the flexible member to produce movement of the trolley in one direction if the user-selected velocity is greater than the selected braking velocity, and to produce movement of the trolley in an opposite direction if the user-selected velocity is less than the selected braking velocity.

81. The apparatus of claim 80 wherein the flexible member is an endless loop operatively engaged by the brake to transmit the braking power thereto and by the input mechanism to transmit the input power thereto, the flexible member including a first length extending between the brake and the input mechanism, the trolley engaging the first length.

82. The apparatus of claim 81 wherein the trolley includes a first idler riding on the flexible member and by which the trolley is engaged by the first length thereof.

83. The apparatus of claim 79 wherein the flexible member has first, second and third lengthwise portions, the first portion of the flexible member extending between the brake and the input mechanism, the differential member including a first rotatable member around which the first portion of the flexible member is engaged for reciprocal movement of the first rotatable member in response to shortening and lengthening of the first portion of the flexible member, the connector member being coupled to the first rotatable member for movement therewith, the brake including a second rotatable member around which the second portion of the flexible member is engaged with the negative braking power being applied to the second portion of the flexible member, and the input mechanism including a third rotatable member around which the third portion of the flexible member is engaged with the positive input power being applied to the third portion of the flexible member, the flexible member transmitting the positive input power and the negative braking power to the differential member while being moved in a unidirection along a path of movement between the second and third rotatable members.

84. The apparatus of claim 83 wherein the flexible member further includes a fourth lengthwise portion extending between the second and third portions of the flexible member such that the flexible member forms an endless loop.

85. The apparatus of claim 79 wherein the flexible member has first, second and third lengthwise portions, the first portion of the flexible member extending between the brake and the input mechanism, the differential member including a rotatable member around which the first portion of the flexible member is engaged for reciprocal movement of the first rotatable member in response to shortening and lengthening of the first portion of the flexible member, the connector member being coupled to the first rotatable member for movement therewith, the brake applying the negative braking power to the second portion of the flexible member, and the input mechanism applying the positive input power to the third portion of the flexible member.

86. The apparatus of claim 69, further including an adjustment member selectively adjustable by the user to select the selected braking velocity of the braking power applied by the brake.

87. The apparatus of claim 86 wherein the resistance member includes a control selectively operable by the user to selectively vary the magnitude of the resistance force, and wherein the adjustment member allows the user to select the selected braking velocity of the braking power applied by the brake independent of the magnitude the user selects for the resistance force.

88. The apparatus of claim 69 wherein the resistance member is selectively variable by the user to selectively vary the magnitude of the resistance force.

89. The apparatus of claim 69 wherein the selected braking velocity of the braking power applied by the brake is selectively adjustable during the user's exercise time to vary the selected braking velocity during the selected portion of the user's exercise time from the selected braking velocity during at least one or more other selected portions of the user's exercise time according to a predetermined pattern.

90. The apparatus of claim 69 wherein the brake includes an alternator operating in conjunction with a load resistor, the rotational speed of the alternator determining the braking velocity of the braking power applied by the brake, and the brake controller includes a feedback loop monitoring the speed of the alternator and controlling the load on the alternator, to control the rotational speed of the alternator.

91. The apparatus of claim 69, further including a flexible member extending between and operatively engaging the brake and the differential member to transmit the braking power therebetween, and extending between and operatively engaging the input mechanism and the differential member to transmit the input power therebetween, and wherein the brake includes a rotatable brake member around which the flexible member is engaged so that the flexible member is fed to the differential member at a feed rate by the rotation of the rotatable brake member during at least the selected portion of the user's exercise time and the input mechanism includes a rotatable input member around which the flexible member is engaged so that the flexible member is drawn away from the differential member at a draw rate determined by the rotational speed of the rotatable input member.

92. An exercise apparatus, comprising:

a movable resistance member applying a resistance force;

an input mechanism having an input member engageable by at least one limb of a user and moveable to input a positive input power with a unidirectional exercise force at a user-selected velocity, the exercise force being determined by the resistance force;

a brake applying a negative braking power with a unidirectional braking force opposing the exercise force, the braking power having a braking velocity, the braking force being determined by the resistance force, with the combined exercise force and braking force being in balance with the resistance force;

a brake controller controlling the application of the brake to maintain a selected braking velocity for at least a selected portion of the user's exercise time; and a differential member coupled to the resistance member and receiving the input power from the input mechanism and the braking power from the brake, the differential member determining a differential between the user-selected velocity and the selected braking velocity, and applying the resultant to the resistance member so that if the user-selected velocity is greater than the selected braking velocity the resistance member is moved in a first direction, and if the user-selected velocity is less than the selected braking velocity the resistance member is moved in a second direction.

93. The apparatus of claim 92 wherein the selected braking velocity is a constant velocity.

94. The apparatus of claim 92 wherein the input member includes a rotatably mounted handle rotatable by the user to input the input power.

95. The apparatus of claim 94 wherein the handle is mounted to allow lateral tilting thereof laterally tiltable by the user while being rotated to input the input power.

96. The apparatus of claim 94 wherein the handle is rotatable by the user in both clockwise and counterclockwise directions to input the input power, and the input mechanism further includes a converter to convert user input clockwise and counterclockwise rotational input power into the unidirectional exercise force.

97. The apparatus of claim 96 wherein the converter includes a unidirectional drive assembly to sum the clockwise and counterclockwise rotational input power into unidirectional rotational input power, the unidirectional drive assembly being coupled to the differential member to transmit the unidirectional input power thereto.

98. The apparatus of claim 94 wherein the handle is coupled to a rotatable member through a converter which converts user movement of the handle into unidirectional rotation of the rotatable member, the rotatable member being coupled to the differential member to transfer the input power with the unidirectional rotation to the differential member.

99. The apparatus of claim 94 wherein the handle is pivotally coupled to a rotatable shaft to permit lateral pivotal movement relative thereto while transmitting rotational movement of the handle to the rotatable shaft, the rotatable shaft being coupled to the differential member to transfer the rotational input power applied to the handle by the user to the differential member.

100. The apparatus of claim 99 wherein the handle is coupled to the rotatable shaft by a universal joint.

101. The apparatus of claim 99 wherein the handle is coupled to the rotatable shaft to transmit both clockwise and counterclockwise rotational movement thereto, and the apparatus further includes a unidirectional drive assembly to sum the clockwise and counterclockwise rotational movement of the rotatable shaft into a unidirectional rotational direction, the drive assembly being coupled to the differential member to transfer the rotational input power applied to the handle by the user to the differential member in the unidirectional rotation direction.

102. The apparatus of claim 92, further including a flexible member interconnecting the input mechanism, the brake and the differential member to transmit the input power and the braking power to the differential member.

103. The apparatus of claim 102 wherein the differential member includes a movable trolley coupled to the resistance member, the trolley being engaged by the flexible member to produce movement of the trolley in one direction if the user-selected velocity is greater than the selected braking velocity, and to produce movement of the trolley in another direction if the user-selected velocity is less than the selected braking velocity.

104. The apparatus of claim 102 wherein the flexible member has first, second and third lengthwise portions, the first portion of the flexible member extending between the brake and the input mechanism, the differential member including a first rotatable member around which the first portion of the flexible member is engaged for reciprocal movement of the first rotatable member in response to shortening and lengthening of the first portion of the flexible member, the resistance member being coupled to the first rotatable member for movement therewith, the brake including a second rotatable member around which the second portion of the flexible member is engaged with the negative braking power being applied to the second portion of the flexible member, and the input mechanism including a third rotatable member around which the third portion of the flexible member is engaged with the positive input power being applied to the third portion of the flexible member, the flexible member transmitting the positive input power and the negative braking power to the differential member while being moved in a unidirection along a path of movement between the second and third rotatable members.

105. The apparatus of claim 104 wherein the flexible member further includes a fourth lengthwise portion extending between the second and third portions of the flexible member such that the flexible member forms an endless loop.

106. The apparatus of claim 102 wherein the flexible member has first, second and third lengthwise portions, the first portion of the flexible member extending between the brake and the input mechanism, the differential member including a rotatable member around which the first portion of the flexible member is engaged for reciprocal movement of the first rotatable member in response to shortening and lengthening of the first portion of the flexible member, the resistance member being coupled to the first rotatable member for movement therewith, the brake applying the negative braking power to the second portion of the flexible member, and the input mechanism applying the positive input power to the third portion of the flexible member.

107. The apparatus of claim 92, further including an adjustment member selectively adjustable by the user to select the selected braking velocity of the braking power applied by the brake.

108. The apparatus of claim 107 wherein the resistance member includes a control selectively operable by the user to selectively vary the magnitude of the resistance force, and wherein the adjustment member allows the user to select the selected braking velocity of the braking power applied by the brake independent of the magnitude the user selects for the resistance force.

109. The apparatus of claim 92 wherein the resistance member is selectively variable by the user to selectively vary the magnitude of the resistance force.

110. The apparatus of claim 92, further including a flexible member extending between and operatively engaging the brake and the differential member to transmit the braking power therebetween, and extending between and operatively engaging the input mechanism and the differential member to transmit the input power therebetween, and wherein the brake includes a rotatable brake member around which the flexible member is engaged so that the flexible member is fed to the differential member at a feed rate by the rotation of the rotatable brake member during at least the selected portion of the user's exercise time and the input mechanism includes a rotatable input member around which the flexible member is engaged so that the flexible member is drawn away from the differential member at a draw rate determined by the rotational speed of the rotatable input member.

111. An exercise apparatus, comprising:

a movable resistance member applying a resistance force;

an input mechanism having an input member engageable by at least one limb of a user and moveable to input an input power with a unidirectional exercise force at a user-selected velocity, the exercise force being determined by the resistance force;

a speed control applying an apparatus-controlled power with a unidirectional apparatus force opposing the exercise force, the apparatus-controlled power having a selected velocity, the apparatus force being determined by the resistance force, with the combined exercise force and apparatus force being in balance with the resistance force, the speed control applying the apparatus-controlled power at the selected velocity for at least a selected portion of the user's exercise time; and a differential member coupled to the resistance member and receiving the input power from the input mechanism and the apparatus-controlled power from the speed control, the differential member determining a differential between the user-selected velocity and the selected velocity, and applying the resultant to the resistance member so that if the user-selected velocity is greater than the selected velocity the resistance member is moved in a first direction, and if the user-selected velocity is less than the selected velocity the resistance member is moved in a second direction.

112. The apparatus of claim 111 wherein the selected speed control velocity is a constant velocity.

113. The apparatus of claim 111 wherein the input member includes a rotatably mounted handle rotatable by the user to input the input power.

114. The apparatus of claim 113 wherein the handle is mounted to allow lateral tilting thereof by the user while being rotated to input the input power.

115. The apparatus of claim 113 wherein the handle is rotatable by the user in both clockwise and counterclockwise directions to input the input power, and the input mechanism further includes a converter to convert user input clockwise and counterclockwise rotational input power into the unidirectional exercise force.

116. The apparatus of claim 115 wherein the converter includes a unidirectional drive assembly to sum the clockwise and counterclockwise rotational input power into unidirectional rotational input power, the unidirectional drive assembly being coupled to the differential member to transmit the unidirectional input power thereto.

117. The apparatus of claim 113 wherein the handle is coupled to a rotatable member through a converter which converts user movement of the handle into unidirectional rotation of the rotatable member, the rotatable member being coupled to the differential member to transfer the input power with the unidirectional rotation to the differential member.

118. The apparatus of claim 113 wherein the handle is pivotally coupled to a rotatable shaft to permit lateral pivotal movement relative thereto while transmitting rotational movement of the handle to the rotatable shaft, the rotatable shaft being coupled to the differential member to transfer the rotational input power applied to the handle by the user to the differential member.

119. The apparatus of claim 118 wherein the handle is coupled to the rotatable shaft by a universal joint.

120. The apparatus of claim 118 wherein the handle is coupled to the rotatable shaft to transmit both clockwise and counterclockwise rotational movement thereto, and the apparatus further includes a unidirectional drive assembly to sum the clockwise and counterclockwise rotational movement of the rotatable shaft into a unidirectional rotational direction, the drive assembly being coupled to the differential member to transfer the rotational input power applied to the handle by the user to the differential member in the unidirectional rotation direction.

121. The apparatus of claim 111, further including a flexible member interconnecting the input mechanism, the speed control and the differential member to transmit the input power and the apparatus-controlled power to the differential member.

122. The apparatus of claim 121 wherein the flexible member has first, second and third lengthwise portions, the first portion of the flexible member extending between the speed control and the input mechanism, the differential member including a first rotatable member around which the first portion of the flexible member is engaged for reciprocal movement of the first rotatable member in response to shortening and lengthening of the first portion of the flexible member, the resistance member being coupled to the first rotatable member for movement therewith, the speed control including a second rotatable member around which the second portion of the flexible member is engaged with the apparatus-controlled power being applied to the second portion of the flexible member, and the input mechanism including a third rotatable member around which the third portion of the flexible member is engaged with the input power being applied to the third portion of the flexible member, the flexible member transmitting the input power and the apparatus-controlled power to the differential member while being moved in a unidirection along a path of movement between the second and third rotatable members.

123. The apparatus of claim 122 wherein the flexible member further includes a fourth lengthwise portion extending between the second and third portions of the flexible member such that the flexible member forms an endless loop.

124. The apparatus of claim 121 wherein the flexible member has first, second and third lengthwise portions, the first portion of the flexible member extending between the speed control and the input mechanism, the differential member including a rotatable member around which the first portion of the flexible member is engaged for reciprocal movement of the first rotatable member in response to shortening and lengthening of the first portion of the flexible member, the resistance member being coupled to the first rotatable member for movement therewith, the speed control applying the apparatus-controlled power to the second portion of the flexible member, and the input mechanism applying the input power to the third portion of the flexible member.

125. The apparatus of claim 111 wherein the speed control includes a brake.

126. An exercise apparatus, comprising:

a vertically movable weight;

an input mechanism engaged by the user to input a positive input power with a unidirectional exercise force at a user-selected velocity for moving the weight upward;

a brake applying a negative braking power with a unidirectional braking force opposing the exercise force, the braking power having a braking velocity for permitting downward movement of the weight;

a brake controller controlling the application of the brake to maintain the braking velocity at a selected velocity for at least a selected portion of the user's exercise time;

a differential member coupled to the weight and receiving the input power from the input mechanism and the braking power from the brake, the differential member determining a differential between the user-selected velocity and the selected braking velocity, and applying the resultant to the weight so that if the user-selected velocity is greater than the braking velocity the weight is lifted, and if the user-selected velocity is less than the selected braking velocity the weight is lowered; and a flexible member interconnecting the input mechanism, the brake and the differential member to transmit the input power and the braking power to the differential member, the flexible member having first, second and third lengthwise portions, the first portion of the flexible member extending between the brake and the input mechanism, the differential member including a rotatable member around which the first portion of the flexible member is engaged to move the first rotatable member in differing first and second directions in response to shortening and lengthening of the first portion of the flexible member, the weight being coupled to the first rotatable member for upward movement in response to movement of the first rotatable member in one of the first and second directions and downward movement in response to movement of the first rotatable member in the other of the first and second directions, the brake applying the negative braking power to the second portion of the flexible member, and the input mechanism applying the positive input power to the third portion of the flexible member.

127. The apparatus of claim 126 wherein the selected braking velocity is a constant velocity.

* * * * *